US007925192B2

(12) United States Patent
Kojima et al.

(10) Patent No.: US 7,925,192 B2
(45) Date of Patent: Apr. 12, 2011

(54) DEVELOPING ROLLER, DEVELOPING DEVICE, PROCESS CARTRIDGE, AND IMAGE FORMING APPARATUS

(75) Inventors: Toshio Kojima, Isehara (JP); Kyohta Koetsuka, Fujisawa (JP); Rei Suzuki, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 124 days.

(21) Appl. No.: 12/201,334

(22) Filed: Aug. 29, 2008

(65) Prior Publication Data

US 2009/0060591 A1 Mar. 5, 2009

(30) Foreign Application Priority Data

Sep. 4, 2007 (JP) ..... 2007-229431
Mar. 4, 2008 (JP) ..... 2008-052989

(51) Int. Cl.
*G03G 15/09* (2006.01)

(52) U.S. Cl. ..... 399/276; 399/279; 399/280; 399/286; 492/28; 492/30; 492/31; 492/33; 492/34; 492/35; 492/36; 492/37

(58) Field of Classification Search ..... 399/239, 399/276, 279–280, 286; 492/28, 30–31, 492/33–37

See application file for complete search history.

(56) References Cited

U.S. PATENT DOCUMENTS 2,241,524 A * 5/1941 Rodgers ..... 451/110
3,943,541 A * 3/1976 Hirafuji ..... 396/607
3,978,817 A * 9/1976 Hauser et al. ..... 399/239
4,024,838 A * 5/1977 Horie ..... 399/239
4,068,620 A * 1/1978 Peters ..... 118/249
4,258,115 A * 3/1981 Magome et al. ..... 430/117.31
4,268,597 A * 5/1981 Klavan et al. ..... 430/102
4,301,583 A * 11/1981 Poole ..... 492/35
4,377,332 A * 3/1983 Tamura ..... 399/275
4,493,550 A * 1/1985 Takekida ..... 399/240
4,564,285 A * 1/1986 Yasuda et al. ..... 399/274
4,786,936 A * 11/1988 Ikegawa et al. ..... 399/272
4,819,558 A * 4/1989 Counard ..... 101/348
4,986,181 A * 1/1991 Kobayashi et al. ..... 101/348
4,993,320 A * 2/1991 Kochsmeier ..... 101/148
5,086,728 A * 2/1992 Kinoshita ..... 399/281
5,093,180 A * 3/1992 Morgan ..... 428/156
5,124,753 A * 6/1992 Asai et al. ..... 399/280
5,153,376 A * 10/1992 Tomita ..... 399/276
5,236,763 A * 8/1993 Luthi ..... 428/156
5,387,966 A * 2/1995 Karashima ..... 399/286
5,502,552 A * 3/1996 Iwata et al. ..... 399/222
5,674,408 A * 10/1997 Suzuki et al. ..... 216/39
5,686,246 A * 11/1997 Kornman et al. ..... 435/6
5,794,109 A * 8/1998 Ota et al. ..... 399/286
5,930,570 A * 7/1999 Saito et al. ..... 399/279

(Continued)

FOREIGN PATENT DOCUMENTS

JP 2000-19848 1/2000

(Continued)

*Primary Examiner* — David M Gray
*Assistant Examiner* — Geoffrey T Evans
(74) *Attorney, Agent, or Firm* — Cooper & Dunham LLP

(57) ABSTRACT

A developing roller includes a developing sleeve and a magnet roller disposed within the developing sleeve to attract developer to an outer surface of the developing sleeve by magnetic force. The outer surface of the developing sleeve has a plurality of recesses of circular or elliptic shape in plan view regularly or irregularly arranged therein so as not to overlap.

16 Claims, 16 Drawing Sheets

U.S. PATENT DOCUMENTS

| | | | | |
|---|---|---|---|---|
| 6,026,265 | A * | 2/2000 | Kinoshita et al. | 399/281 |
| 6,104,903 | A * | 8/2000 | Hara et al. | 399/265 |
| 6,149,564 | A * | 11/2000 | Nozawa et al. | 492/30 |
| 6,178,306 | B1 * | 1/2001 | Mizoguchi et al. | 399/276 |
| 6,196,958 | B1 * | 3/2001 | Shiraki et al. | 492/59 |
| 6,681,092 | B2 * | 1/2004 | Terai | 399/267 |
| 6,925,277 | B2 * | 8/2005 | Sugihara | 399/276 |
| 6,941,103 | B2 * | 9/2005 | Schlien | 399/325 |
| 7,060,191 | B2 * | 6/2006 | Iwase | 216/8 |
| 7,139,514 | B2 * | 11/2006 | Nakamura et al. | 399/239 |
| 7,149,459 | B2 * | 12/2006 | Kamijo et al. | 399/239 |
| 7,167,666 | B2 * | 1/2007 | Munakata et al. | 399/237 |
| 7,356,294 | B2 * | 4/2008 | Ishida et al. | 399/286 |
| 7,466,947 | B2 * | 12/2008 | Zemba | 399/276 |
| 7,555,252 | B2 * | 6/2009 | Aruga et al. | 399/286 |
| 7,599,650 | B2 * | 10/2009 | Katoh et al. | 399/279 |
| 7,625,605 | B2 * | 12/2009 | Cooprider et al. | 427/286 |
| 7,729,647 | B2 * | 6/2010 | Koike et al. | 399/285 |
| 7,751,760 | B2 * | 7/2010 | Koike et al. | 399/285 |
| 2001/0048827 | A1 * | 12/2001 | Okada | 399/276 |
| 2003/0110632 | A1 * | 6/2003 | Iwase | 29/895.32 |
| 2005/0069348 | A1 * | 3/2005 | Fujita et al. | 399/237 |
| 2005/0069349 | A1 * | 3/2005 | Nakamura et al. | 399/237 |
| 2006/0111223 | A1 * | 5/2006 | Chou | 492/37 |
| 2006/0193660 | A1 * | 8/2006 | Imamura | 399/276 |
| 2007/0110481 | A1 * | 5/2007 | Yamada et al. | 399/279 |
| 2007/0110484 | A1 * | 5/2007 | Yamada et al. | 399/286 |
| 2007/0147906 | A1 * | 6/2007 | Sakurai et al. | 399/286 |
| 2008/0107455 | A1 * | 5/2008 | Suzuki et al. | 399/286 |
| 2008/0199801 | A1 * | 8/2008 | Akioka et al. | 430/112 |
| 2008/0273901 | A1 * | 11/2008 | Toyama et al. | 399/286 |
| 2008/0279598 | A1 * | 11/2008 | Van Dessel | 399/286 |
| 2008/0298853 | A1 * | 12/2008 | Yamada et al. | 399/279 |
| 2009/0148195 | A1 * | 6/2009 | Ochiai | 399/276 |
| 2009/0148197 | A1 * | 6/2009 | Yamada et al. | 399/284 |
| 2009/0185819 | A1 * | 7/2009 | Aruga et al. | 399/103 |
| 2009/0185838 | A1 * | 7/2009 | Aruga et al. | 399/286 |
| 2009/0208255 | A1 * | 8/2009 | Yamada et al. | 399/286 |
| 2009/0208256 | A1 * | 8/2009 | Yamada et al. | 399/286 |
| 2009/0214271 | A1 * | 8/2009 | Yamada et al. | 399/284 |
| 2009/0226221 | A1 * | 9/2009 | Takahashi | 399/286 |
| 2009/0245891 | A1 * | 10/2009 | Sakurai et al. | 399/286 |
| 2010/0098464 | A1 * | 4/2010 | Suzuki et al. | 399/286 |
| 2010/0143007 | A1 * | 6/2010 | Eun et al. | 399/286 |
| 2010/0150617 | A1 * | 6/2010 | Maeda et al. | 399/284 |
| 2010/0150618 | A1 * | 6/2010 | Kurebayashi et al. | 399/286 |
| 2010/0158578 | A1 * | 6/2010 | Kojima et al. | 399/276 |
| 2010/0261111 | A1 * | 10/2010 | Aruga et al. | 430/105 |

FOREIGN PATENT DOCUMENTS

| | | | |
|---|---|---|---|
| JP | 2002072692 | A * | 3/2002 |
| JP | 2004-191835 | | 7/2004 |
| JP | 2006-139075 | | 6/2006 |
| JP | 2006-251301 | | 9/2006 |
| JP | 2007-86091 | | 4/2007 |
| JP | 2007-94287 | | 4/2007 |
| JP | 4041732 | | 11/2007 |

* cited by examiner

DEVELOPING ROLLER, DEVELOPING DEVICE, PROCESS CARTRIDGE, AND IMAGE FORMING APPARATUS

CROSS-REFERENCE TO RELATED APPLICATIONS

The present patent application claims priority under 35 U.S.C. §119 from Japanese Patent Application Nos. 2007-229431, filed on Sep. 4, 2007, and 2008-052989, filed on Mar. 4, 2008 in the Japan Patent Office, the entire contents of each of which are hereby incorporated herein by reference.

BACKGROUND

1. Technical Field

This disclosure relates to a developing roller, a developing device, a process cartridge, and an image forming apparatus, and more specifically, to a developing roller that transports developer carried on a developing sleeve to a development area, in which the developing sleeve faces a photoconductive drum across a gap, to develop an electrostatic latent image on the photoconductive drum into a visible toner image, a developing device having the developing roller, and a process cartridge and an image forming apparatus having the developing device.

2. Description of the Background

Image forming apparatuses are used as copiers, facsimile machines, printers, and multi-functional devices combining several of the foregoing capabilities. A conventional type of image forming apparatus carries developer on a developing sleeve of a developing roller to securely transport the developer to a photoconductive drum. The outer surface of such developing sleeve is subjected to surface processing such as sandblasting, grooving, or so-called electromagnetic blasting in which filamentous materials are contacted against the outer surface of the developing sleeve by a rotating magnetic field.

Such sandblasting or grooving may prevent a reduction in image density due to slippage and provide better retention of the developer on the developing sleeve during rotation at high speed.

A conventional type of developing sleeve having an outer surface subjected to sandblasting may be made of aluminum alloy, brass, stainless steel, or conductive resin, for example. Typically, aluminum alloy is used in view of cost reduction and processing accuracy. When performing sandblasting on the outer surface of such developing sleeve made of aluminum alloy, for example, an aluminum tube is extruded in a sleeve shape at high-temperature, and abrasive grains are cold-sprayed against the aluminum tube to form convex and concave portions on the outer surface of the developing sleeve. The surface roughness is in a range of approximately 5.0 μm to 15 μm. Such surface roughening enables the developing sleeve to retain the developer even during rotation at high speed, thereby preventing the developer from slipping.

However, because such convex and concave portions are relatively fine, they may also be abraded by the developer as well as other materials. Accordingly, the outer surface of such sandblasted developing sleeves gradually wears down and becomes smooth as the number of print outputs increases over time. Consequently, a transport amount of developer, which is the amount of developer that the developing sleeve can transport at any given time, may gradually decrease, resulting in such failures as reduced image density. Thus, such conventional sandblasted sleeves suffer from relatively poor durability. It is possible to provide better durability by making the developing sleeve out of a stainless steel having a high rigidity or its outer surface may be otherwise hardened, but at the price of an increase in cost.

A conventional type of developing sleeve having a grooved outer surface may be similarly made of aluminum alloy, brass, stainless steel, or conductive resin, for example. Similar to the above-described developing sleeve subjected to sandblasting, typically such conventional developing sleeve is made of aluminum alloy for cost reduction and processing accuracy. When forming grooves on the outer surface of such developing sleeve made of aluminum alloy, for example, an aluminum tube extruded in a shape of the developing sleeve at high temperature is pulled into cold air and then grooves are formed on the outer surface of the aluminum tube with a die. Typically, such grooves have a rectangular shaped, V-shaped, or U-shaped cross section. Such grooves also have a depth of, for example, approximately 0.2 mm. For example, when such developing sleeve has an outer diameter of 25 mm, typically the number of grooves is approximately 50. Such developing sleeve subjected to grooving, even when rotating at a high speed, is capable of retaining developer in the grooves on the outer surface of the developing sleeve, thereby preventing the developer from slipping on the developing sleeve.

For such grooved developing sleeve, such grooves are relatively larger in size than the convex and concave portions generated by sandblasting and more resistant to abrasion, thereby suppressing a reduction in the transport amount of developer due to a change over time. In other words, such developing sleeve may be more durable than the above-described developing sleeve subjected to sandblasting.

However, in such conventional grooved developing sleeve, the amount of developer transported in the grooves is generally greater than the amount of developer transported in an area having no grooves, thereby resulting in a cyclical variation in image density or so-called "pitch-like uneven density" due to such grooves. Typically, the deeper such grooves, the higher the transport performance of developer while the more likely such pitch-like uneven density is to occur due to, for example, a difference in the intensity of development electric field between the grooves and the lands, or intervals, between the grooves.

By contrast, the shallower such grooves, the less likely such pitch-like uneven density in view of the intensity of the development electric field. However, when the grooves are clogged with toner, additive, and/or carrier, the degree of reduction in the transport performance of developer may increase to such a degree that such pitch-like uneven density occurs more readily.

Hence, in the conventional developing sleeve, the grooves have a depth of not less than 0.05 mm and not more than 0.15 mm to maintain a preferred level of developer transfer performance while preventing occurrence of pitch-like uneven density.

Meanwhile, recent advances in image forming technology, such as a toner and a magnetic carrier of relatively smaller particle diameters or close-proximity developing method, have enhanced image reproducibility, thereby causing such pitch-like uneven density to become more noticeable when it does occur. For example, a development method using a toner having a relatively small average particle diameter of not more than approximately 8.5 μm may provide excellent image reproducibility. At the same time, however, the resultant image is relatively highly sensitive to variation in the amount of developer used for development, thereby causing such pitch-like uneven density to become more noticeable.

A conventional type of image forming apparatus uses a small-particle-diameter toner having a volume average particle diameter of not less than 4 μm and not more than 8.5 μm. In such image forming apparatus, a plurality of grooves is formed on the outer surface of the developing sleeve so as to extend in a longitudinal direction of the developing sleeve. The interval between adjacent grooves is set smaller than the width, in a surface moving direction of the photoconductive drum, of a development area, in which the developer contacts a photoconductive drum, so that the image forming apparatus has at least one groove on the developing sleeve positioned in the development area to prevent the developer carried on the developing sleeve from slipping thereon. As a result, such variation in the amount of developer in such development area may be relatively suppressed compared to an image forming apparatus in which no groove is present in the development area at any given time. Thus, even when using a small particle-diameter toner having a volume average particle diameter of, for example, not more than 8.5 μm, such image forming apparatus may produce a better quality image with excellent image reproducibility while suppressing pitch-like uneven density due to a difference in image density.

However, in the above-described developing sleeve, the interval between grooves must be set relatively small, which may impose a limitation on the method by which the grooves are die-formed after pulling an aluminum tube into cold air. Alternatively, even if the interval between grooves is large enough to accommodate additional grooves, during cutting or grinding performed as finishing the dimension of outer diameter, variations in the depth of grooves may increase, thereby resulting in unevenness in image density.

Meanwhile, with regard to the method for forming grooves, when such grooves are individually cut, the pitch between the grooves can be narrower. Alternatively, when multiple grooves are cut simultaneously, the variation in the depth of grooves can be reduced. However, such methods for forming grooves may increase the number of processing steps, thereby increasing cost.

Alternatively, the above-described electromagnetic blast processing may suppress a reduction in the transport amount of developer due to a change over time. However, because filamentous materials are contacted against the outer surface of a developing sleeve at random, it may be difficult to set a processing condition suitable for providing a long stability of the developer while obtaining an optimal scooped amount of the developer. It may also be difficult to further increase the scooped amount of developer to maintain a high image quality even in a future higher-speed image forming apparatus.

In a conventional type of image forming apparatus, a developing roller may be disposed close to a doctor blade of a plate shape for regulating the thickness of a layer of developer carried on its outer surface to a certain thickness. Typically, the amount of toner supplied to a photoconductive drum is adjustable by adjusting a gap (hereinafter a "doctor gap") between the doctor blade and the outer surface of the developing roller. Regardless of the shape or surface processing of the outer surface, a friction resistance generated by the developer passing through the doctor gap and a magnetic attraction of the developer may bend the developing roller, thereby causing the doctor gap to be wider at a middle portion in the longitudinal direction of the developing roller than at each end portion supported by a shaft. As a result, the amount of toner supplied is greater at the middle portion in the longitudinal direction of the developing roller than at each end portion, thereby resulting in unevenness in image density in the longitudinal direction of the developing roller.

In view of the above-described situation, the present invention provides a developing roller and a developing device capable of preventing unevenness in image density while suppressing a reduction in the transport amount of developer due to a change over time. The present invention also provides a process cartridge and an image forming apparatus having the developing device.

SUMMARY

In an aspect of this disclosure, there is provided a developing roller and a developing device capable of preventing unevenness in image density while suppressing a reduction in the transport amount of developer due to a change over time, and a process cartridge and an image forming apparatus having the developing device.

In an exemplary embodiment, a developing roller includes a developing sleeve and a magnet roller disposed within the developing sleeve to attract developer to an outer surface of the developing sleeve by magnetic force. The outer surface of the developing sleeve has a plurality of recesses of circular or elliptic shape in plan view regularly or irregularly arranged therein so as not to overlap.

In another exemplary embodiment, a developing device includes a developing roller that in turn includes a developing sleeve and a magnet roller disposed within the developing sleeve to attract developer to an outer surface of the developing sleeve by magnetic force. The outer surface of the developing sleeve has a plurality of recesses of circular or elliptic shape in plan view regularly or irregularly arranged therein so as not to overlap.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
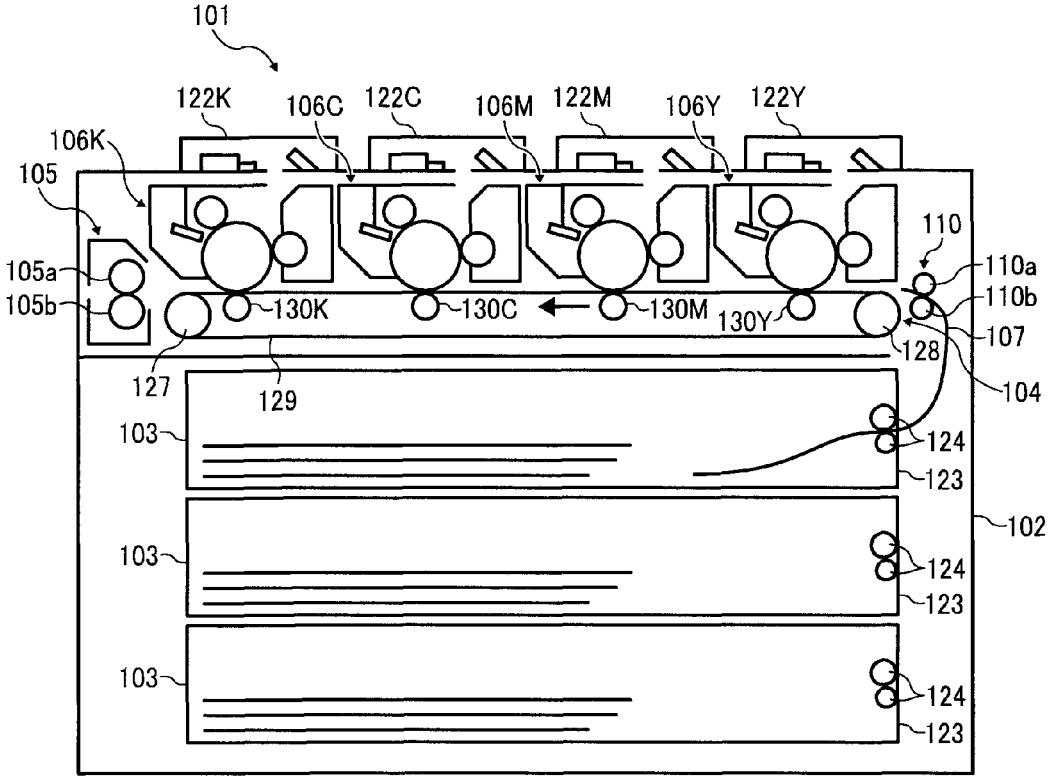
FIG. 1 is a front view illustrating a configuration of an image forming apparatus having a developing sleeve according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results.

While exemplary embodiments of the invention are capable of various modifications and alternative forms, embodiments thereof are shown by way of example in the drawings and will herein be described in detail. It should be understood, however, that there is no intent to limit exemplary embodiments of the present invention to the particular forms disclosed. On the contrary, exemplary embodiments are to cover all modifications, equivalents, and alternatives falling within the scope of the invention. Like numbers refer to like elements throughout the description of the figures.

Below, an exemplary embodiment of the present invention is described with reference to FIGS. 1 to 8.

FIG. 1 is a schematic view illustrating a configuration of an image forming apparatus according to the present exemplary embodiment viewed from its front side.

Figure 2:
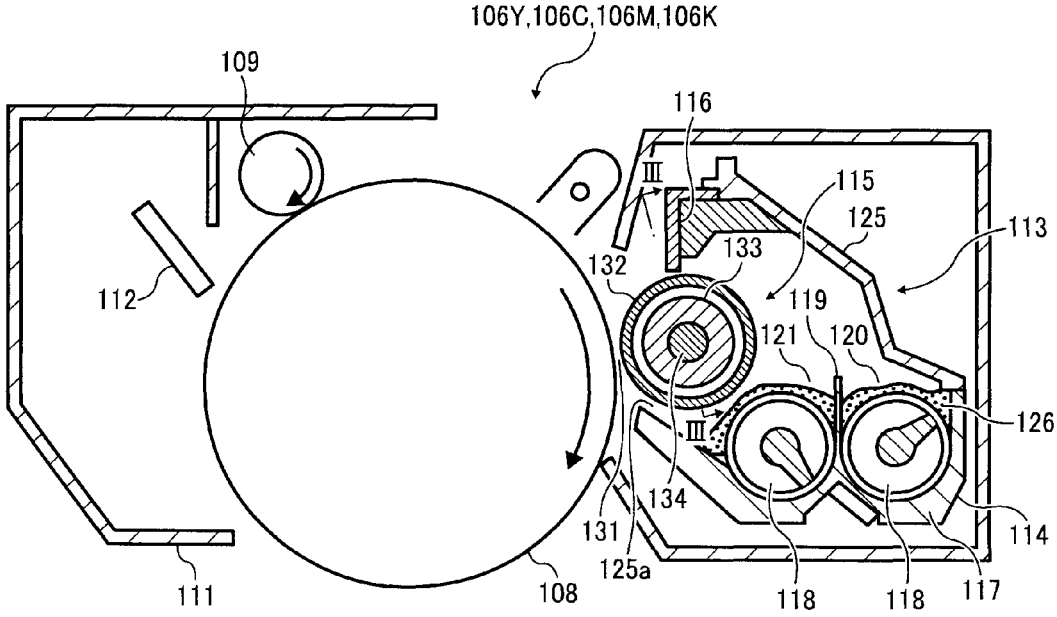
FIG. 2 is a sectional view illustrating a process cartridge of the image forming apparatus illustrated in FIG. 1.

FIG. 2 is a sectional view illustrating a configuration of a developing device according to an exemplary embodiment used in the image forming apparatus of FIG. 1.

Figure 3:
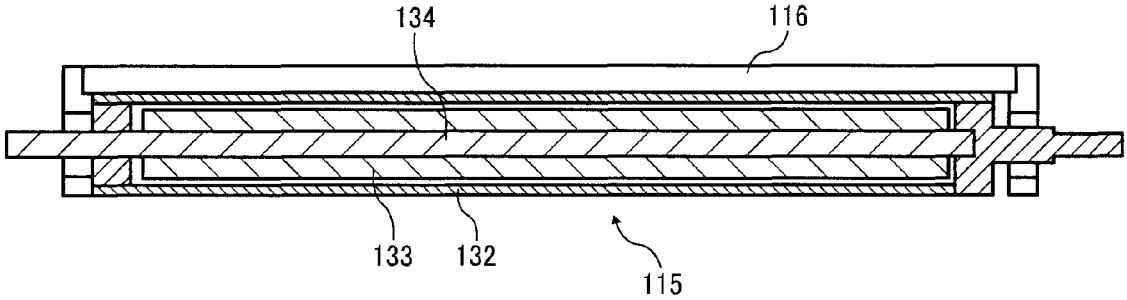
FIG. 3 is a sectional view cut along a line III-III illustrated in FIG. 2.

FIG. 3 is a sectional view illustrating the developing device of FIG. 2 cut along a line III-III in FIG. 2.

Figure 4:
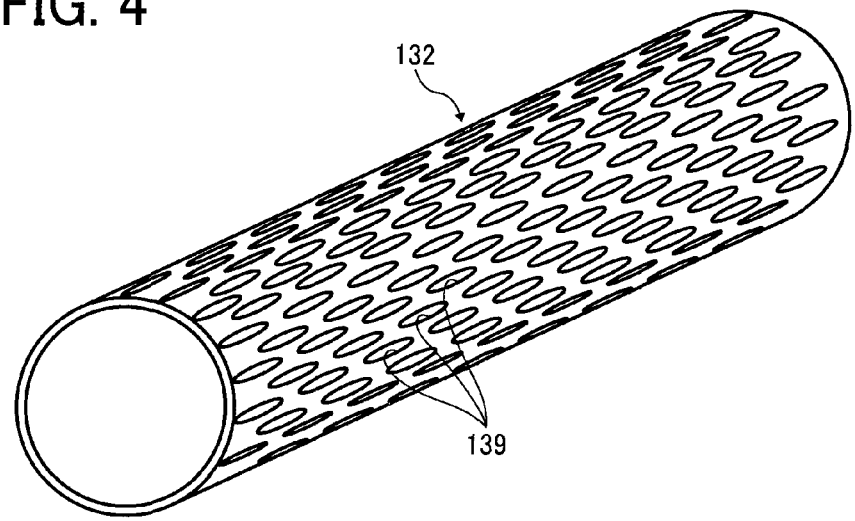
FIG. 4 is a perspective view illustrating a developing sleeve of the image forming apparatus illustrated in FIG. 1.

FIG. 4 is a perspective view illustrating a developing sleeve of the developing device of FIG. 2.

Figure 5:
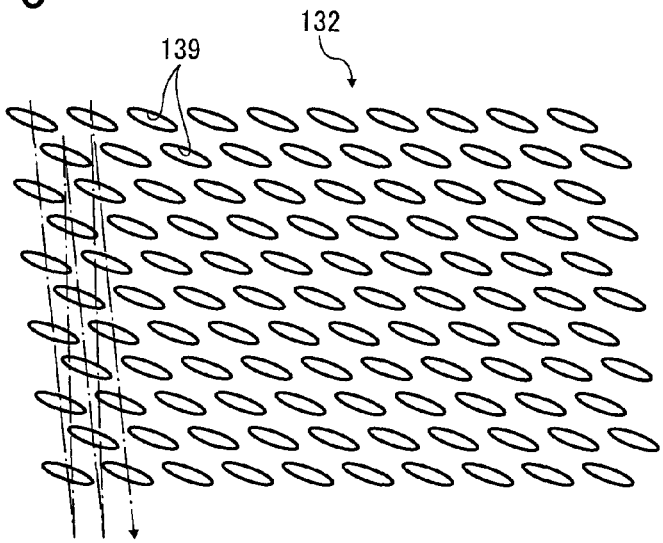
FIG. 5 is a schematic extended view illustrating an outer surface of the developing sleeve illustrated in FIG. 4.

FIG. 5 is an extended elevation view of the outer surface of the developing sleeve illustrated in FIG. 4.

In FIG. 1, the image forming apparatus 101 forms yellow (Y), magenta (M), cyan (C), and black (K) images on a recording sheet 107 serving as a sheet of transfer material. Hereinafter, reference numerals for components, devices, and units for yellow, magenta, cyan, and black are accompanied with reference letters Y, M, C, and K, respectively.

As illustrated in FIG. 1, the image forming apparatus 101 typically has an apparatus body 102, a plurality of sheet feed units 103, a plurality of registration roller pairs 110, a transfer unit 104, a fixing unit 105, a plurality of optical writing units 122Y, 122M, 122C, and 122K, and a plurality of process cartridges 106Y, 106M, 106C, 106K.

The apparatus body 102 is formed in a box shape, for example, and located on a floor. The apparatus body 102 houses the sheet feed units 103, the registration roller pairs 110, the transfer unit 104, the fixing unit 105, the optical writing units 122Y, 122M, 122C, and 122K, and the process cartridges 106Y, 106M, 106C, and 106K, for example.

The sheet feed units 103 are provided at a lower portion of the apparatus body 102. It should be noted that the number of sheet feed units 103 is not limited to three as illustrated in FIG. 1 but may be one of any other suitable number. Each of the sheet feed units 103 has a sheet feed cassette 123 and a sheet feed roller pair 124. The sheet feed cassette 123 is capable of storing a stack of recording sheets 107 and is detachably insertable into the apparatus body 102. The sheet feed roller pair 124 is pressed against a recording sheet 107 on top of the stack stored in the sheet feed cassette 123. The sheet feed roller pair 124 feeds the topmost recording sheet 107 between a conveyance belt 129 of the transfer unit 104 and a photoconductive drum 108 of a developing device 113 in each of the process cartridges 106Y, 106M, 106C, and 106K.

The plurality of registration roller pairs 110 is disposed along a feed path of the recording sheet 107 fed from one of the sheet feed units 103 to the transfer unit 104. Each registration roller pair 110 has a pair of rollers 110*a* and 110*b* to sandwich the recording sheet 107 therebetween. Each registration roller pair 110 feeds the recording sheet 107 between the transfer unit 107 and each of the process cartridges 106Y, 106M, 106C, and 106K at such a timing that toner images are appropriately superimposed onto the recording sheet 107.

The transfer unit 104 is disposed above the sheet feed units 103. The transfer unit 104 has a driving roller 127, a driven roller 128, the conveyance belt 129, and transfer rollers 130Y, 130M, 130C, and 130K. The driving roller 127 is rotated by a motor serving as a driving source and disposed at a downstream side in a direction in which the recording sheet 107 is conveyed by the conveyance belt 129. The driven roller 128 is rotatably supported by the apparatus body 102 and disposed at an upstream side in the conveyance direction of the recording sheet 107. The conveyance belt 129 is formed in an endless shape and extended between the driving roller 127 and the driven roller 128. As the driving roller 127 rotates, the conveyance belt 129 is circulated, or endlessly moved, in a counterclockwise direction in FIG. 1 between the driving roller 127 and the driven roller 128.

The conveyance belt 129 and the recoding sheet 107 carried thereon are sandwiched between the transfer rollers 130Y, 130M, 130C, and 130K and the respective photoconductive drums 108 of the process cartridges 106Y, 106M, 106C, and 106K. In the transfer unit 104, the transfer rollers 130Y, 130M, 130C, and 130K press the recording sheet 107, which is fed from the sheet feed unit 103, against respective outer surfaces of the photoconductive drums 108 of the process cartridges 106Y, 106M, 106C, and 106K to transfer toner images from the photoconductive drums 108 onto the recording sheet 107. The transfer unit 104 forwards the recording sheet 107 having the toner images toward the fixing unit 105.

The fixing unit 105 is disposed at a downstream side of the transfer unit 104 in the conveyance direction of the recording sheet 107 and has a pair of rollers 105*a* and 105*b* to sandwich the recording sheet 107 therebetween. The fixing unit 105 presses and heats the recording sheet 107, which is forwarded from the transfer unit 104 to the rollers 105*a* and 105*b*, to fix the toner images on the recording sheet 107.

The optical writing units 122Y, 122M, 122C, and 122K are mounted at an upper portion of the apparatus body 102 so as to correspond to the process cartridges 106Y, 106M, 106C, and 106K, respectively. The optical writing units 122Y, 122M, 122C, and 122K emit laser light onto the respective outer surfaces of the photoconductive drums 108 uniformly charged by charging rollers 109 in the process cartridges 106Y, 106M, 106C, and 106K to form electrostatic latent images on the outer surfaces of the photoconductive drums 108.

The process cartridges 106Y, 106M, 106C, and 106K are provided between the transfer unit 104 and the optical writing units 122Y, 122M, 122C, and 122K. The process cartridges 106Y, 106M, 106C, and 106K are detachably mountable to the apparatus body 102 and arranged side by side along the conveyance direction of the recording sheet 107.

As illustrated in FIG. 2, each of the process cartridges 106Y, 106M, 106C, and 106K has a cartridge case 111, the charging roller 109 serving as a charging device, the photoconductive drum 108 serving as an image carrier, a cleaning blade 112 serving as a cleaning device, and the developing device 113, for example. Accordingly, in such case, the image forming apparatus 101 has at least the charging rollers 109, the photoconductive drums 108, the cleaning blades 112, and the developing devices 113.

In each of the process cartridges 106Y, 106M, 106C, and 106K, the cartridge case 111 is detachably mountable to the apparatus body 102 and houses the charging roller 109, the photoconductive drum 108, the cleaning blade 112, and the developing device 113. The charging roller 109 substantially uniformly charges the outer surface of the photoconductive drum 108. The photoconductive drum 108 is disposed close to a developing roller 115 across a gap and formed in a cylindrical shape so as to be rotatable around its axis. On the outer surface of the photoconductive drum 108, an electrostatic latent image is formed by a corresponding one of the optical writing units 122Y, 122M, 122C, and 122K. Toner particles are attracted to the electrostatic latent image formed on the outer surface of the photoconductive drum 108 to develop a toner image. The toner image thus obtained is transferred onto the recording sheet 107 positioned between the photoconductive drum 108 and the conveyance belt 129. After the transfer, the cleaning blade 112 removes residual toner remaining on the outer surface of the photoconductive drum 108.

As illustrated in FIG. 2, the developing device 113 has a developer supply section 114, a case 125, the developing roller 115 serving as a developer carrier, and a doctor blade 116 serving as a regulation member, for example.

The developer supply section 114 has a container 117 and a pair of agitation screws 118 serving as an agitation member. The container 117 is formed in a box shape and has a length substantially identical to a length of the photoconductive drum 108. In the container 117 is provided a separation wall 119 extending in a longitudinal direction of the container 117. The separation wall 119 separates a first compartment 120 and a second compartment 121 in the container 117. The first compartment 120 and the second compartment 121 communicate at both end portions thereof.

The container 117 is capable of containing developer 126 in each of the first compartment 120 and the second compartment 121. The developer 126 includes toner and magnetic carrier (magnetic powder). As necessary, such toner is supplied to a first end portion of the first compartment 120, which is the farther of the two compartments 120 and 121 relative to the developing roller 115. Such toner is formed of fine particles of a substantially round shape produced by an emulsion polymerization method or a suspension polymerization method. Alternatively, such toner may be produced by crushing a block of a synthetic resin, for example, in which a plurality of different types of dyes or pigments is mixed and dispersed. The average particle diameter of such toner is not less than 3 μm and not more than 7 μm, for example. Alternatively, such toner may be produced by any other suitable type of crushing processing.

The magnetic carrier is contained in each of the first compartment 120 and the second compartment 121. The average particle diameter of magnetic carrier is not less than 20 μm and not more than 50 μm, for example.

The agitation screws 118 are disposed in the first compartment 120 and the second compartment 121. The longitudinal direction of each agitation screw 118 is parallel to the longitudinal direction of each of the container 117, the developing roller 115, and the photoconductive drum 108. Each agitation screw 118 is provided so as to be rotatable around its axis. With a rotation around its axis, each agitation screw 118 transports the developer 126 along the axis while agitating the toner and the magnetic carrier.

In FIG. 2, the agitation screw 118 of the first compartment 120 transports the developer 126 from the above-described first end portion to a second end portion of the first compartment 120 on the side opposite on the side of the first end portion. The second compartment 121 has first and second end portions corresponding to those of the first compartment 120. The agitation screw 118 of the second compartment 121 transports the developer 126 from the second end portion to the first end portion of the second compartment 121.

According to the above-described configuration, when the toner is supplied to the first end portion of the first compartment 120, the developer supply section 114 transports the toner and the magnetic carrier to the second end portion while agitating the toner and the magnetic carrier, and then transports the toner and the magnetic carrier from the second end portion of the first compartment 120 to the second end portion of the second compartment 121. The developer supply section 114 also agitates the toner and the magnetic carrier in the second compartment 121, transports them along the axis of the second compartment 121, and supplies them to the outer surface of the developing roller 115.

The case 125 is formed in a box shape, for example, and mounted to the container 117 of the developer supply section 114 so as to cover the developing roller 115 together with the container 117. Further, the case 125 has an opening 125*a* at a portion facing the photoconductive drum 108.

The developing roller 115 is formed in a cylindrical shape and disposed close to the opening 125*a* between the second compartment 121 and the photoconductive drum 108. The developing roller 115 is disposed parallel to each of the photoconductive drum 108 and the container 117 and across a gap from the photoconductive drum 108. The gap between the developing roller 115 and the photoconductive drum 108 forms a development area 131 at which the toner of the developer 126 is attracted to the photoconductive drum 108 to develop the electrostatic latent image into a visible toner image. The developing roller 115 and the photoconductive drum 108 face each other at the development area 131.

As illustrated in FIGS. 2 and 3, the developing roller 115 has a metal core 134, a magnet roller or a magnet body 133 having a cylindrical shape, and the developing sleeve 132 having the cylindrical shape. The longitudinal direction of the metal core 134 is parallel to the longitudinal direction of the photoconductive drum 108. The metal core 134 is affixed to the case 125 so as not to be rotated.

The magnet roller 133 is made of a magnetic material and formed in a cylindrical shape. The magnet roller 133 has a plurality of fixed magnetic poles, not illustrated, and is affixed around an outer circumference of the metal core 134 so as not to rotate around the axis.

The plurality of fixed magnetic poles constitutes magnets of a long rod shape mounted to the magnet roller 133. Each fixed magnetic pole extends along a longitudinal direction of the magnet roller 133 or the developing roller 115 and disposed over a whole length of the magnet roller 133. The magnet roller 133 having the above-described configuration is contained in the developing sleeve 132.

A first fixed magnetic pole of the fixed magnetic poles faces one of the agitation screws 118 and forms a scooping magnetic pole. The first fixed magnetic pole generates a magnetic force to attract the developer 126, stored in the second compartment 121 of the container 117, to the outer surface of the developing sleeve 132.

A second fixed magnetic pole of the fixed magnetic poles faces the photoconductive drum 108 and forms a developing magnetic pole. The second fixed magnetic pole generates a magnetic force on the outer surface of the developing sleeve 132 or the developing roller 115 to form a magnetic field between the developing sleeve 132 and the photoconductive drum 108. The second fixed magnetic pole forms a magnetic brush by the magnetic field to transfer the toner of the developer 126, attached to the outer surface of the developing sleeve 132, to the photoconductive drum 108.

At least one fixed magnetic pole is provided between the scooping magnetic pole and the developing magnetic pole. The at least one fixed magnetic pole generates a magnetic force on the outer surface of the developing sleeve 132 or the developing roller 115 to transport the developer 126 before development to the photoconductive drum 108 and transport the developer 126 after development from the photoconductive drum 108 to the container 117.

When the above-described fixed magnetic poles attract the developer 126 to the outer surface of the developing sleeve 132, a plurality of carrier particles of the magnetic carrier of the developer 126 are superposed one on another along a magnetic line of force generated by the corresponding fixed magnetic pole so as to stand at the outer surface of the developing sleeve 132. Such state, in which a plurality of magnetic carrier particles stands at the outer surface of the developing sleeve 132, is referred to as "grain standing". Toner is attracted to the magnetic carrier standing on the outer surface of the developing sleeve 132. Thus, the developing sleeve 132 attracts the developer 126 to its outer surface by the magnetic force of the magnetic roller 133.

The development sleeve 132 has a cylindrical shape as illustrated in FIG. 4. The development sleeve 132 includes the magnetic roller 133 and provided so as to be rotatable around its axis. The development sleeve 132 rotates in such a manner that its inner surface faces the respective fixed magnetic poles in turn. The developing sleeve 132 is made of aluminum alloy, brass, stainless steel (SUS), conductive resin, or any other suitable non-magnetic material. With a surface processing device 1 illustrated in FIG. 8A, granulation finishing is performed on the outer surface of the developing sleeve 132.

For example, aluminum alloy may be excellent in view of easiness of processing or lightness. Preferably, such aluminum alloy is A6-63, A5056, or A3003, for example. For SUS, preferably used are SUS303, SUS304, or SUS316, for example. In drawings, the developing sleeve 132 is assumed to be made of aluminum alloy.

Preferably, the developing sleeve 132 has an outer diameter of approximately 17 mm to approximately 18 mm, for example. The length of the developing sleeve 132 is in a range of approximately 300 mm to approximately 350 mm in the axial direction or the direction of the axis.

As illustrated in FIGS. 4, 5, 6A, and 7, a plurality of recesses 139 having an elliptic shape in top plane view are provided on the outer surface of the developing sleeve 132. The recesses 139 are dented on the outer surface of the developing sleeve 132 and regularly arranged so as not to overlap with each other. In this disclosure, the term "regularly arranged" refers to a state in which adjacent recesses of the recesses 139 in each of the circumferential and longitudinal directions of the developing sleeve 132 are arranged at a certain interval. Further, in this disclosure, the term "irregularly arranged" refers to a state in which adjacent recesses of the recesses 139 in each of the circumferential direction and the longitudinal direction of the developing sleeve 132 are arranged at variable intervals.

Figure 24:
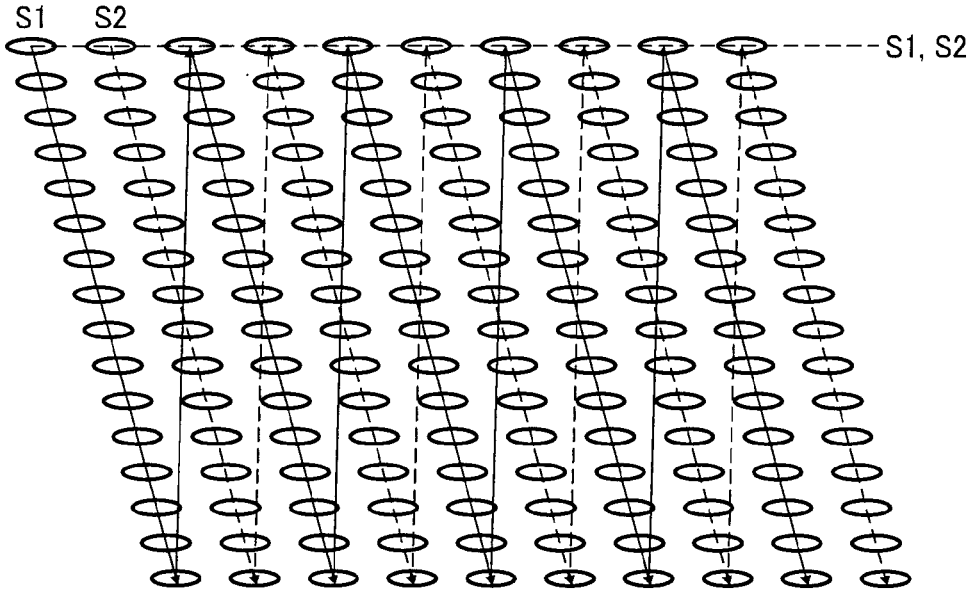
FIG. 24 illustrates an example in which recesses are regularly arranged.
Figure 25:
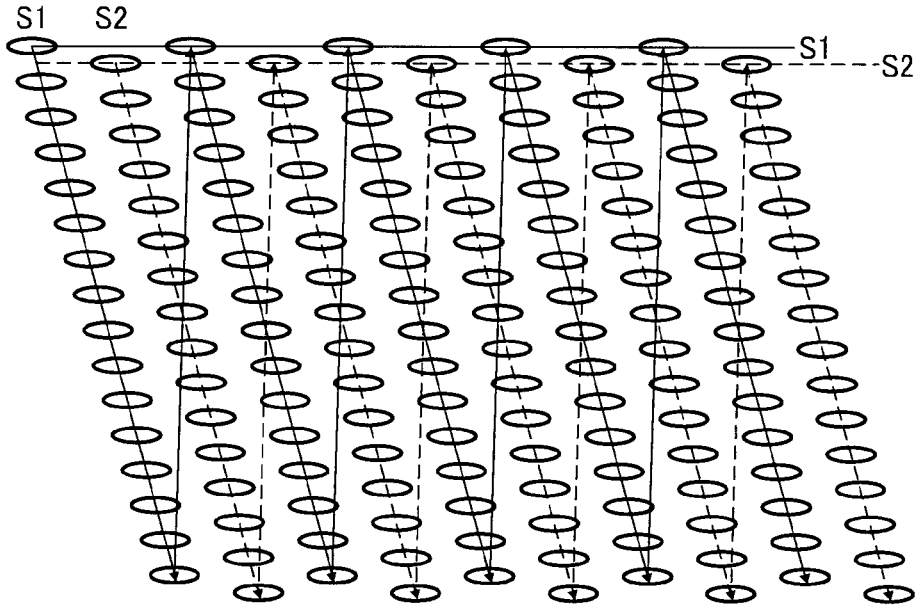
FIG. 25 illustrates another example in which recesses are regularly arranged.

In one example in which the recesses 139 are regularly arranged, the recesses 139 form a single spiral as illustrated in FIG. 5 and arranged at a certain pitch or interval in the circumferential direction of the developing sleeve 132. In another example, as illustrated in FIG. 24, the recesses 139 form two, first and second, spirals Si and S2 so that recesses 139 of each spiral are arranged at a certain pitch in the circumferential direction of the developing sleeve 132 and recesses 139 of the first spiral S1 are aligned with recesses 139 of the second spiral S2 in the longitudinal direction of the developing sleeve 132. In still another example, as illustrated in FIG. 25 the recesses 139 form two, first and second, spirals S1 and S2 in such a manner that recesses 139 of each spiral are arranged at a certain pitch and recesses 139 of the first spiral S1 are shifted to the circumferential direction so as not to align with recesses 139 of the second spiral S2 in the longitudinal direction of the developing sleeve 132. Alternatively, when the recesses 139 form three or more spirals, recesses 139 of each spiral are arranged in a manner similar to any of the above-described examples.

Figure 22:
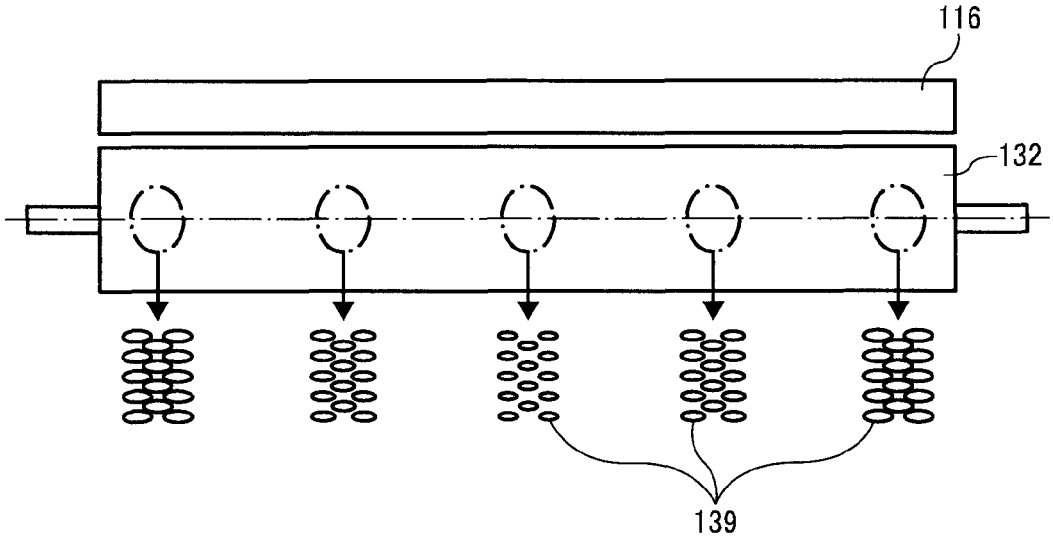
FIG. 22 is an extended schematic view illustrating the outer surface of another variation example of the developing sleeve illustrated in FIG. 5, in which the size of recesses in plan view gradually increases from the middle portion to each end portion in the longitudinal direction of the developing sleeve.
Figure 23:
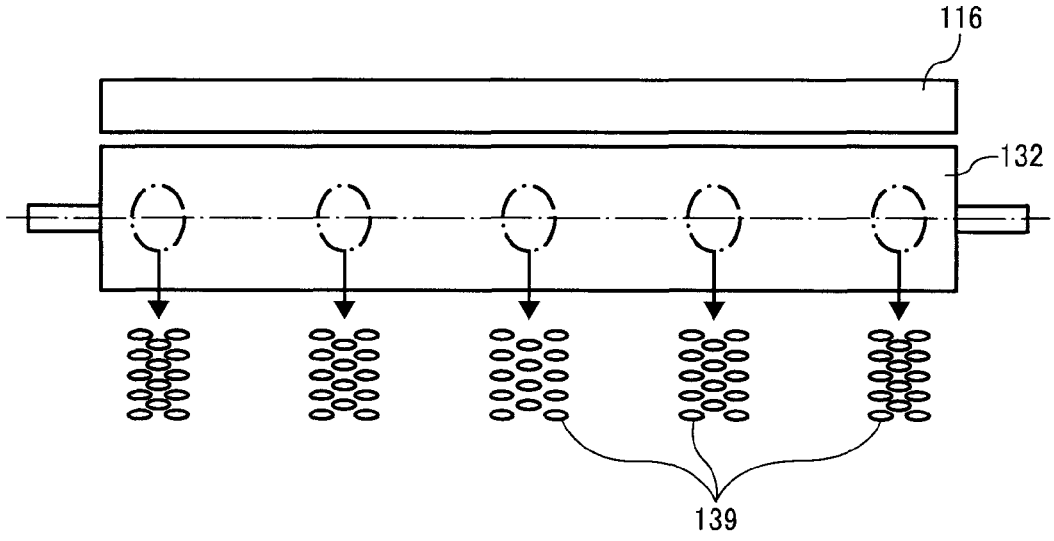
FIG. 23 is an extended schematic view illustrating the outer surface of still another variation example of the developing sleeve illustrated in FIG. 5 in which the number of recesses per unit area gradually increases from the middle portion to each end portion in the longitudinal direction of the developing sleeve.
Figure 26:
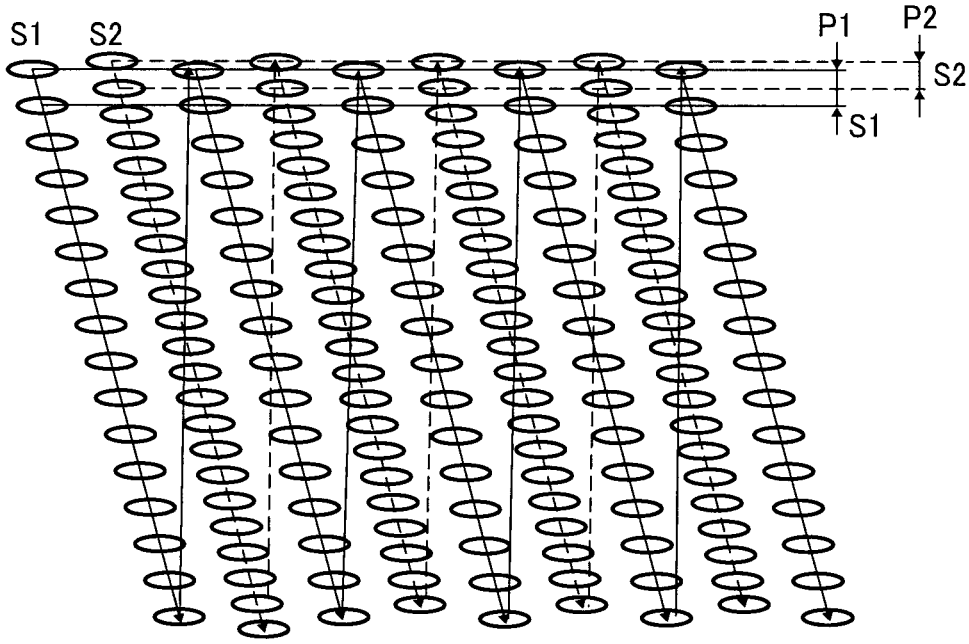
FIG. 26 illustrates an example in which recesses are irregularly arranged.
Figure 27:
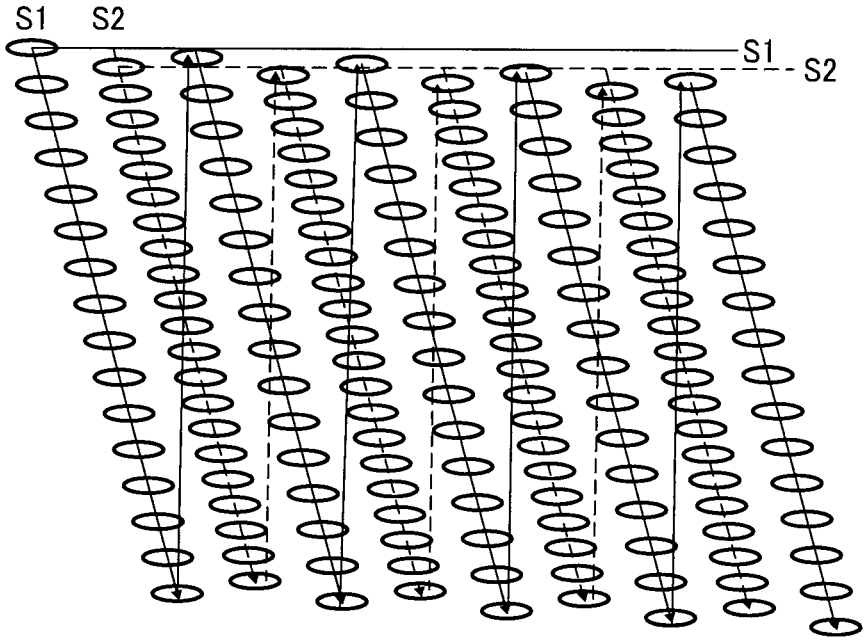
FIG. 27 illustrates another example in which recesses are irregularly arranged.

In one example in which the recesses 139 are irregularly arranged, as illustrated in FIGS. 22 and 23 the recesses 139 are disposed in such a manner that the interval between the recesses 139 gradually becomes narrower toward a certain direction (e.g., a direction from a middle portion to each end portion in the longitudinal direction of the developing sleeve 132). In another example, as illustrated in FIG. 26, the recesses 139 form two, first and second, spirals S1 and S2 in such a manner that recesses 139 of the first spiral S1 are arranged at a certain pitch P1 different from a certain pitch 2 of recesses 139 of the second spiral S2 in the circumferential direction of the developing sleeve 132 and aligned with the recesses 139 of the second spiral S2 in the longitudinal direction of the developing sleeve 132. In still another example, as illustrated in FIG. 27 the recesses 139 form two, first and second, spirals S1 and S2 in such a manner that recesses 139 of the first spiral S1 are arranged at a certain pitch P1 different from a certain pitch P2 of recesses 139 of the second spiral S2 in the circumferential direction of the developing sleeve 132 (e.g., P1>P2) and shifted in the circumferential direction so as not to align with the recesses 139 of the second spiral S2 in the longitudinal direction of the developing sleeve 132. Alternatively, when the recesses 139 form three or more spirals, recesses 139 of each spiral are arranged in a manner similar to any of the above-described examples.

The longitudinal direction of each recess 139 is disposed along the longitudinal direction of the developing sleeve 132. In other words, the recesses 139 are arranged in such a manner that the longitudinal direction of each recess 139 is parallel or substantially parallel to the longitudinal direction of the developing sleeve 132. In the drawings, the longitudinal direction of each recess 139 is slightly inclined or substantially parallel to the longitudinal direction of the developing sleeve 132. It should be noted that, as described above, in this disclosure, the state in which the longitudinal direction of each recess 139 is disposed "parallel" to the longitudinal direction of the developing sleeve 132 refers to a state in which the longitudinal direction of each recess 139 is arranged parallel or substantially parallel to the longitudinal direction of the developing sleeve 132.

Figure 6A:
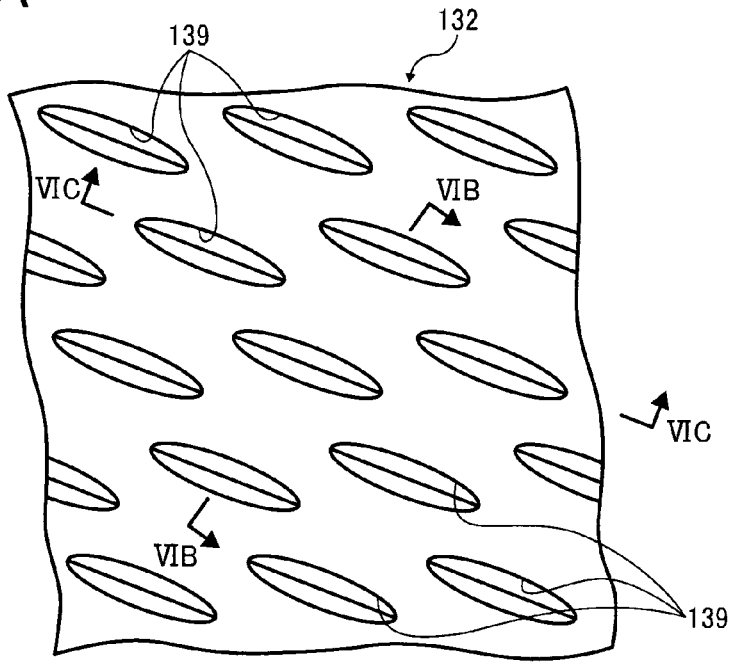
FIG. 6A is a schematic enlarged view illustrating a portion of the outer surface of the developing sleeve illustrated in FIG. 5.
Figure 7:
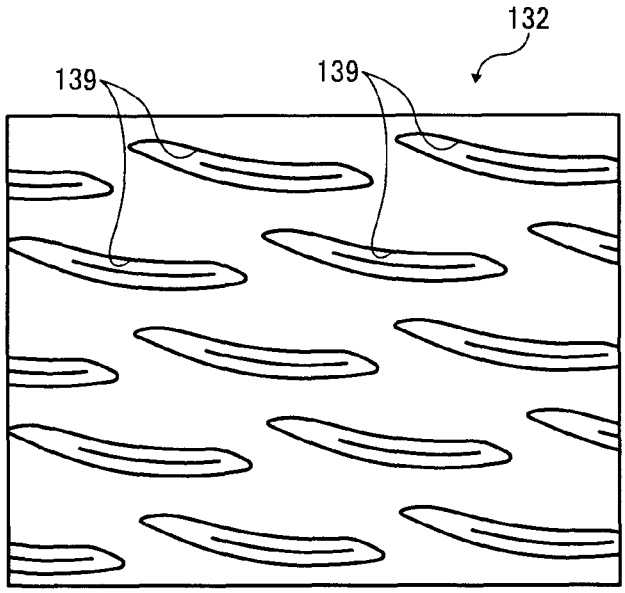
FIG. 7 is an enlarged view illustrating a portion of the outer surface of the developing sleeve illustrated in FIG. 4.

As illustrated in FIGS. 5, 6A, and 7, the recesses 139 are arranged along the longitudinal direction of the developing sleeve 132 in such a manner that adjacent recesses of the recesses 139 in the circumferential direction of the developing sleeve 132 are offset from each other by approximately half of the length of the recesses 139. When the recesses 139 are formed on the outer surface of the developing sleeve 132 by, for example, the surface processing device 1 of FIG. 8A, the recesses 139 are arranged in a spiral shape indicated by alternate long and short dashed lines in FIG. 5.

Figure 6B:
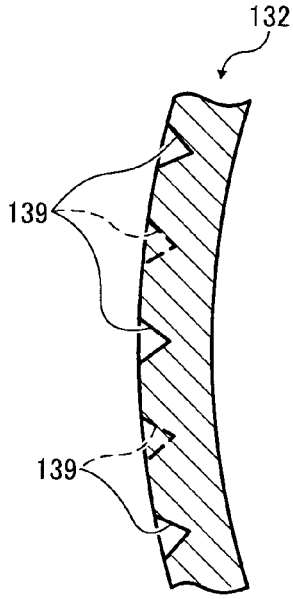
FIG. 6B is a sectional view cut along a line VIB-VIB illustrated in FIG. 6A.
Figure 6C:
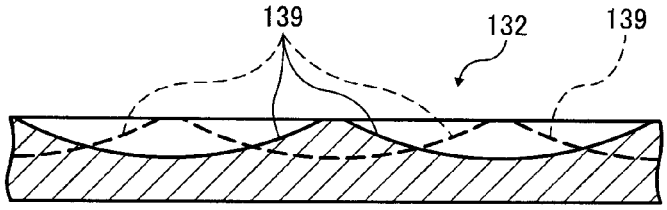
FIG. 6C is a sectional view cut along a line VIC-VIC illustrated in FIG. 6A.

The recesses 139 have a substantially V-shaped cross section in a width direction (or the circumferential direction of the developing sleeve 132) as illustrated in FIG. 6B and a curved, arc-shaped cross section in a longitudinal direction (or the longitudinal direction of the developing sleeve 132). When the recesses 139 are formed on the outer surface of the developing sleeve 132 by the surface processing device 1 of FIG. 8A, as illustrated in FIG. 7 the longitudinal direction of the recesses 139 is slightly bent in an arc shape. It should be noted that, in this disclosure, when a recess has a longitudinal length greater than its width and outer edges are formed in a curved shape, such shape of the recess is referred to collectively as an elliptic shape when the longitudinal direction of the recess is straight or slightly curved.

The recesses 139 have a longitudinal length or a major axis of not less than 1.0 mm and not greater than 2.3 mm, a width or a minor axis of not less than 0.3 mm and not greater than 0.7 mm, and a depth of not less than 0.05 mm and not greater than 0.15 mm, for example. The recesses 139 may be provided at a density of approximately 50 to 250 per 100 $mm^2$ of the outer surface of the developing sleeve 132. In other words, a total capacity of the recesses 139 may be in a range of not less than 0.5 $mm^3$ and not greater than 7.0 $mm^3$ per 100 $mm^2$ of the outer surface of the developing sleeve 132. The recesses 139 are provided at a rate of not less than one and not greater than three per 1.0 mm in the circumferential direction of the photoconductive drum 108 rotating together with the developing sleeve 13. In FIGS. 5, 6A, and 7, the longitudinal direction of the developing sleeve 132 corresponds to the horizontal direction of each drawing.

Typically, the deeper the recesses 139, the higher the transport performance of the developer 126 by the developing sleeve 132 while the more likely a cyclic pitch-like uneven density is to occur similar to a conventional type of developing sleeve in which grooves are formed on its outer surface. By contrast, the shallower the recesses 139, the less likely such cyclic pitch-like uneven density is to occur while the lower the transport performance of the developer 126.

Recent advances in image forming technology, such as a toner and a magnetic carrier of relatively smaller particle diameters or close-proximity developing method, have enhanced image reproducibility, thereby causing such pitch-like uneven density to become more noticeable.

Figure 28:
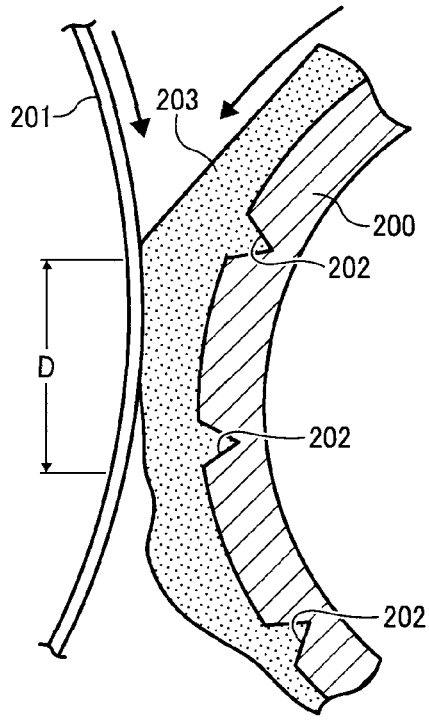
FIG. 28 illustrates a state in which developer is scooped by a conventional type of developing sleeve.
Figure 29:
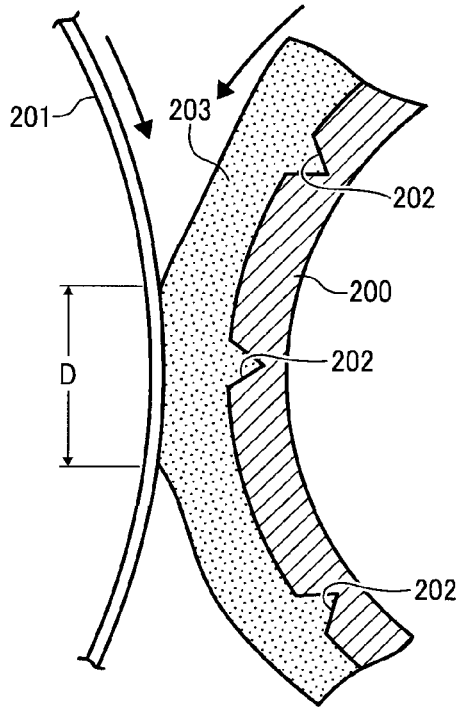
FIG. 29 illustrates another state in which the developer is scooped by the conventional type of developing sleeve illustrated in FIG. 24.

In the examination of its cause, the inventors of the present disclosure found that, as illustrated in FIGS. 28 and 29, in a developing area D in which a developing sleeve 200 faces a photoconductive drum 201, developer 203 slips at an area at which grooves 202 are not formed on the outer surface of the developing sleeve 200, thereby reducing the amount of the developer 203 and a resultant image density. Generally, although the developer 203 is transported to the development area D, a relatively great amount of developer 203 need be transported to the development area D to obtain a sufficient image density.

Hence, the developing sleeve 200 is typically rotated at a surface speed of 1.1 to 2.5 times as high as a surface speed of the photoconductive drum 201. When the developer 203 passes through the development area D at a high speed, the friction between the developer 203 and the photoconductive drum 201 rotating at a relatively low speed generates a resistance load, thereby resulting in the slip of the developer 203 or the lack of the scooped amount of the developer 203 in the area in which the grooves 202 are not formed on the outer surface of the developing sleeve 200 as illustrated in FIG. 28. As a result, the amount of developer 203 on a downstream side of the development area D may be less than the amount of developer 203 on an upstream side thereof. By contrast, when the developer 203 passes through the grooves 202 in the development area D, a sufficient transport performance can be obtained. Thus, the developer 203 can be prevented from slipping on the outer surface of the developing sleeve 200 and a sufficient scooped amount of the developer 126 can be obtained. In other words, the amount of developer 203 may vary depending on the presence and absence of such slip at a cycle at which the grooves 202 pass through the development area D, thereby resulting in pitch-like uneven density due to a difference in image density.

Hence, in the developing sleeve 132 according to the present exemplary embodiment, the recesses 139 are relatively shallow to increase the distribution density of the recesses 139, thereby providing a relatively high transport performance of the developer while preventing occurrence of such pitch irregularity.

The doctor blade 116 is provided at an end portion closer to the photoconductive drum 108 of the developing device 113. The doctor blade 116 is mounted to the case 125 across a gap between the doctor blade 116 and the outer surface of the developing sleeve 132. The doctor blade 116 scrapes an excess portion of the developer 126, which is beyond a desired thickness, from the outer surface of the developing sleeve 132 into the container 117, so that the developer 126 transported to the development area 131 is adjusted to the desired thickness on the outer surface of the developing sleeve 132.

The developing device 113 having the above-described configuration sufficiently agitates toner and magnetic carrier in the developer supply section 114 and attracts the developer 126, including the agitated toner and magnetic carrier, to the outer surface of the developing sleeve 132 by the fixed magnetic poles. In the developing device 113, as the developing sleeve 132 rotates, the developer 126 attracted by the fixed magnetic poles is transported to the development area 131. The developing device 113 attracts the developer 126, which is adjusted to the desired thickness by the doctor blade 116, to the photoconductive drum 108. Thus, the developing device 113 carries the developer 126 on the developing roller 115, transport the developer 126 to the development area 131, and develops an electrostatic latent image on the photoconductive drum 108 into a toner image.

The developing device 113 separates the developer 126, which has been used for the development process, from the developing roller 115 toward the container 117. Such used developer 126 collected in the container 117 is agitated together with another developer 126 and used to develop the electrostatic latent image on the photoconductive drum 108. The developing device 113 transports toner to the developing roller 115 by rotation of the agitation screws 118 when a later-described toner density sensor detects, for example, a reduction in the density of toner which the developer supply section 114 supplies to the photoconductive drum 108.

The image forming apparatus 101 having the above-described configuration forms an image on a recording sheet 107 in the following manner. At first, in the image forming apparatus 101, as the photoconductive drum 108 is rotated, the outer surface of the photoconductive drum 108 is uniformly charged with the charging roller 109 at substantially −700V. By emitting a laser beam onto the outer surface of the photoconductive drum 108, the photoconductive drum 108 is exposed so that the charging voltage of an image area is reduced to approximately −150V. Thus, an electrostatic latent image is formed on the outer surface of the photoconductive drum 108. When the electrostatic latent image reaches the development area 131, a development bias voltage of approximately −550V is supplied to the electrostatic latent image. As a result, the developer 126, which is attracted to the outer surface of the developing sleeve 132 of the developing device 113, is adhered to the outer surface of the photoconductive drum 108. Thus, the electrostatic latent image is developed into a toner image on the outer surface of the photoconductive drum 108.

In the image forming apparatus 101, the recoding sheet 107, which is fed by the sheet feed roller pair 124 of the relevant sheet feed unit 103, is conveyed between the conveyance belt 129 of the transfer unit 104 and the photoconductive drum 108 of each of process cartridges 106Y, 106M, 106C, and 106K. The toner image, which is formed on the outer surface of the photoconductive drum 108, is transferred onto the recording sheet 107. The image forming apparatus 101 fixes the toner image on the recording sheet 107 in the fixing unit 105. Thus, the image forming apparatus 101 forms a color image on the recording sheet 107.

Residual toner remaining on the photoconductive drum 108 after transfer is collected with the cleaning blade 112. After such residual toner is removed, a discharging device (e.g., a discharge lamp), not illustrated, initializes the photoconductive drum 108 in preparation for a subsequent image forming process.

The above-described image forming apparatus 101 performs process control to suppress variation in image quality due to change in use environment and with time. More specifically, the process control detects a development performance of the developing device 113. For example, an image of a toner pattern is formed on the photoconductive drum 108 at a constant development-bias voltage. The density of the image is detected with an optical sensor, not illustrated, to determine the development performance of the developing device 113 based on a change in the image density. Then, a target value of the toner density is adjusted so that the development performance satisfies a certain target level, thereby allowing the image quality to be maintained at a certain level. For example, when an image density of a toner pattern detected by the optical sensor is lower than a target development density, the CPU serving as a controller controls a driving circuit of a motor for driving the agitation screws 118 so as to increase the toner density. By contrast, when an image density of a toner pattern detected by the optical sensor is higher than a target development density, the CPU controls the driving circuit of the motor so as to reduce the toner density. At this time, the toner density is detected by a toner density sensor, not illustrated. The image density of the toner pattern formed on the photoconductive drum 108 may vary to some degree due to cyclic unevenness in image density of the developing sleeve 132.

Figure 8A:
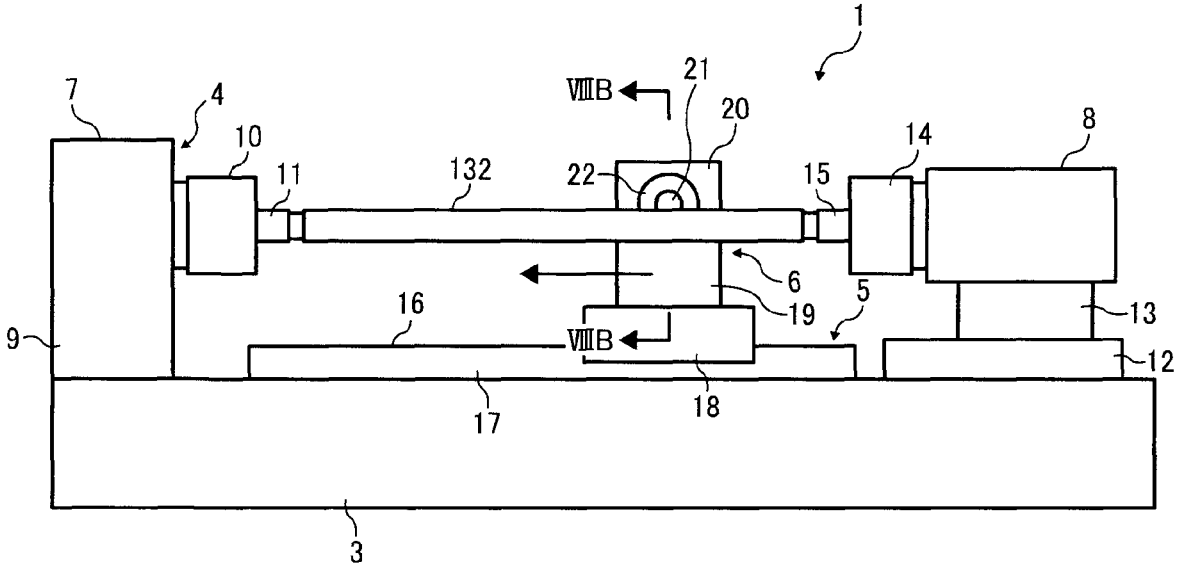
FIG. 8A is a side view illustrating a schematic configuration of a surface processing device that performs cutting processing on the outer surface of the developing sleeve illustrated in FIG. 4.

The recesses 139 are formed on the outer surface of the developing sleeve 132 using the surface processing device 1 illustrated in FIG. 8A.

As illustrated in FIG. 8A, the surface processing device 1 has, for example, a base 8, a holder unit 4, a motor 2 serving as a driving unit, a tool shifter 5 serving as a shifting unit, a tool 6, and a controller, not illustrated, serving as a control unit.

The base 3 is formed in a flat shape and located on a floor of a factory or a table. An upper face of the base 3 is maintained horizontally. The base 3 also has a rectangular shape in plan view.

The holder unit 4 has a fixation holder 7 and a slide holder 8. The fixation hold portion 7 has a fixed pillar 9 standing at one end portion in a longitudinal direction of the base 3 and a rotation chuck 10 provided at an upper end portion of the fixed pillar 9. The rotation chuck 10 is formed in a thick disk shape and supported at the upper end portion of the fixed pillar 9 so as to be rotatable around a rotation center thereof. The rotation center of the rotation chuck 10 is disposed parallel to the upper surface of the base 3. A chuck pin 11 having a cylindrical shape is mounted to a middle portion of the rotation chuck 10. The chuck pin 11 is provided coaxially with the rotation chuck 10.

The slide holder 8 has a slider 12, a slide pillar 13, and a rotation chuck 14 provided at an upper end portion of the slide pillar 13. The slider 12 is provided so as to be slidable along the upper surface of the base 3 or the axis of the chuck pin 11 of the rotation chuck 10. The slider 12 is locked at any position in the axial direction of the chuck pin 11 of the rotation chuck 10 as needed.

The slide pillar 13 stands at the slider 12. The rotation chuck 14 is formed in a thick disk shape and mounted on an output shaft of the motor 2, which is provided in the upper end portion of the slide pillar 13. The rotation center of the rotation chuck 14 is provided coaxially with the chuck pin 11 of the rotation chuck 10 of the fixation holder 7. The chuck pin 15 having a cylindrical shape is mounted to a middle portion of the rotation chuck 14. The chuck pin 15 is provided coaxially with the rotation chuck 14.

For the above-described holder unit 4, when the developing sleeve 132, on which the recesses 139 are not formed yet, is set between the chuck pins 11 and 15 with the slide holder 8 distant from the fixation holder 7, the slide holder 8 is approached to the fixation holder 7 so that respective tips of the chuck pins 11 and 15 are inserted into end portions of the developing sleeve 132. As a result, the slider 12 is fixed with the developing sleeve 132 sandwiched between the chuck pins 11 and 15. Thus, the holder unit 4 holds the developing sleeve 132 by sandwiching the developing sleeve 132 with the chuck pins 11 and 15.

The motor 2 is mounted to the upper end portion of the slide pillar 13 of the slide holder 8. The motor 2 drives the rotation chuck 14 so that the rotation chuck 14 rotates around its axis. As the motor 2 rotates the rotation chuck 14, the developing sleeve 132 sandwiched between the chuck pins 11 and 15 is rotated around the axis of the developing sleeve 132.

The tool shifter 5 has a linear guide 16 and an actuator, not illustrated. The linear guide 16 has a rail 17 and a slider 18 and mounted on the base 3. The rail 17 is formed in a linear shape and provided in a manner that the longitudinal direction of the rail 17 is parallel to the longitudinal direction of the base 3 or the axis of the developing sleeve 132 sandwiched between the chuck pins 11 and 15. The slider 18 is supported on the rail 17 so as to be movable along the longitudinal direction of the rail 17.

The actuator is mounted on the base 3 and slides the slider 18 in the longitudinal direction of the base 3 or along the axis of the developing sleeve 132 sandwiched between the chuck pins 11 and 15.

The tool 6 has a tool body 19, a tool rotation motor 20 serving as a tool rotation unit, and an end mill 21 serving as a rotational tool. The tool body 19 is formed in a pillar shape and provided to stand at the slider 18.

Figure 8B:
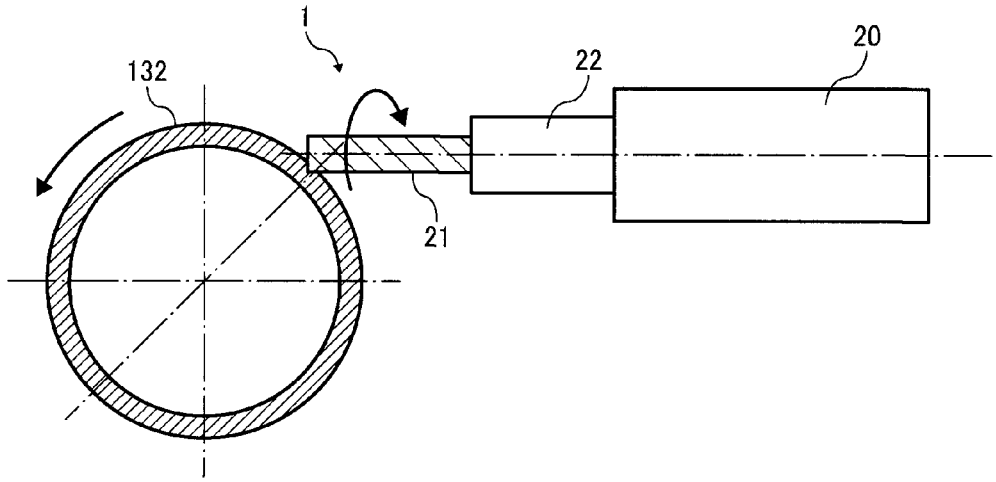
FIG. 8B is a sectional view cut along a line VIIIB-VIIIB illustrated in FIG. 8A.

The tool rotation motor 20 is mounted to an upper end portion of the tool body 19. As illustrated in FIG. 8B, the tool rotation motor 20 has an output shaft 22 projecting from the upper end portion of the tool body 19 toward the developing sleeve 132 sandwiched between the chuck pins 11 and 15. The output shaft 22 of the tool rotation motor 20 is disposed in such a manner that the axis of the output shaft 22 is parallel to the upper surface of the base 3 and crosses (or, as illustrated in FIG. 8B, is perpendicular to) the axis of the developing sleeve 132 sandwiched between the chuck pins 11 and 15.

The end mill 21 has a cylindrical shape as a whole and is mounted to a tip of the output shaft 22 of the tool rotation motor 20. The end mill 21 is disposed in such a manner that its axis is parallel to the upper surface of the base 3 and crosses (or, as illustrated in FIG. 8B, is perpendicular to) the axis of the developing sleeve 132 sandwiched between the chuck pins 11 and 15. The end mill 21 is provided so as to project from the upper end portion of the tool body 19 toward the developing sleeve 132 sandwiched between the chuck pins 11 and 15.

Figure 8C:
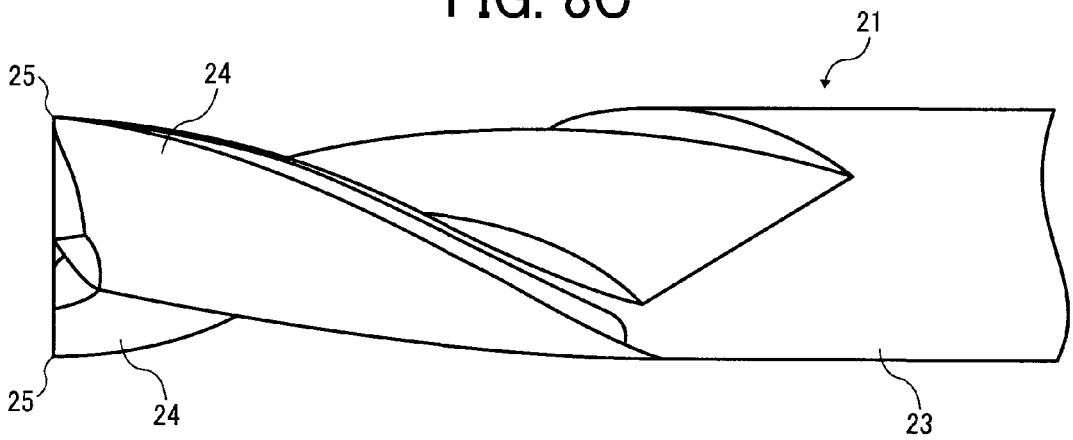
FIG. 8C is an enlarged side view illustrating an end mill illustrated in FIG. 8B.
Figure 8D:
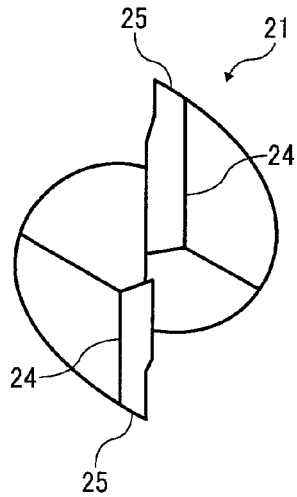
FIG. 8D is a front view illustrating a tip of the end mill illustrated in FIG. 8C.

As illustrated in FIG. 8C, the end mill 21 has a mill body 23 of a cylindrical shape and two cutting blades 24. The mill body 23 is mounted to the tool body 19. The two cutting blades 24 are disposed at a tip of the mill body 23, which is on a side close to the developing sleeve 132, with an interval in a circumferential direction of the mill body 23. As illustrated in FIG. 8D, the cutting blades 24 are provided so as to project in an outer circumferential direction of the mill body 23 or the end mill 21 beyond an outer edge of the tip portion of the mill body 23 and extend in a spiral shape. According to the present exemplary embodiment, as illustrated in FIG. 8C, outer edges 25 of the cutting blades 24 of the end mill 21 have an acute angle in cross section.

In the above-described tool 6, the tool rotation motor 20 rotates the end mill 21 around its axis, thereby forming the recesses 139 on the outer surface of the developing sleeve 132.

The controller is a computer having, for example, a RAM (random access memory), a ROM (read-only memory), and a CPU (central processing unit). The controller is connected to the motor 2 serving as the driving unit, the actuator of the tool shifter 5, the tool rotation motor 20 of the tool 6, and other components, to control the entire surface processing device 1 through such components.

When a great number of recesses 139 are formed on the outer surface of the developing sleeve 132, the controller causes the motor 2 to rotate the developing sleeve 132 around its axis. The controller causes the tool rotation motor 20 to rotate the end mill 21 around its axis and, at the same time, causes the actuator to shift the tool 6 along the axis of the developing sleeve 132 or in the longitudinal direction of the developing sleeve 132. The controller causes the cutting blades 24 to intermittently perform cutting processing on the outer surface of the developing sleeve 132 with the rotation of the end mill 21, thereby forming a great number of recesses 139 on the outer surface of the developing sleeve 132.

At this time, the curvature radius of the arcs of the recesses 139 in the longitudinal direction of the developing sleeve 132 is defined by the curvature radius of the outer edges of the cutting blades 24. The depth of the recesses 139 is defined by the cut amount of the cutting blades 24. The interval between recesses 139 in the longitudinal direction of the developing sleeve 132 is defined by the moving speed of the tool 6. The controller controls the motor 2, the actuator of the tool shifter 5, and the tool rotation motor 20 of the tool 6 so as to satisfy the following equation:

$$N2=N1\times[m/\{(n/2)-0.5\}]$$

where "n" represents the number of the recesses 139 arranged in the circumferential direction of the outer surface of the developing sleeve 132, "N1" represents the rotation speed of the motor 2 serving as the driving unit or the rotation speed of the developing sleeve 132, "m" represents the number of the cutting blades 24 of the end mill 21, and "N2" represents the rotation number of the end mill 21, By changing such elements as necessary, the controller processes the outer surface of the developing sleeve 132 at any suitable size and/or density of recesses 139.

The controller is connected to various input devices such as a keyboard and various display devices such as a display.

Next, a description is given of a procedure in which the developing sleeve 132 is produced by performing cutting processing on the outer surface of the developing sleeve 132 using the surface processing device 1 having the above-described configuration.

At first, an operator inputs information, such as a product number of the developing sleeve 132, from an input device to the controller. When the controller sets the end mill 21 to a processing start position or one end portion of the developing sleeve 132, the developing sleeve 132, on which the recesses 139 are not formed yet, is held in the holder unit 4. At this time, the developing sleeve 132 is coaxial with the chuck pins 11 and 15.

When the operator inputs an operation start instruction from the input device, the controller drives the motor serving as the driving unit, the actuator of the tool shifter 5, and the tool rotation motor 20 of the tool 6 based on the above-described equation. The cutting blades 24 of the end mill 21 rotating around its axis intermittently performs cutting processing on the outer surface of the developing sleeve 132, thereby forming the recesses 139 thereon. In other words, cutting processing is intermittently performed on the outer surface of the developing sleeve 132 by the rotational tool 6 rotated around its axis, so that the recesses 139 are formed on the outer surface of the developing sleeve 132.

The motor 2 serving as the driving unit, the actuator of the tool shifter 5, and the tool rotation motor 20 are driven at the same time. When the rotational tool 6 rotated around its axis performs cutting processing on the outer surface of the developing sleeve 132 to form the recesses 139 thereon, the developing sleeve 132, which is disposed so as to cross (or is, as illustrated in FIG. 8B, perpendicular to) the end mill 21, is rotated around its axis. At the same time, the end mill 21 and the developing sleeve 132 are relatively moved in the longitudinal direction of the developing sleeve 132, thereby forming the recesses 139 on the outer surface of the developing sleeve 132.

When the end mill 21 is positioned to a processing end position of the developing sleeve 132 or another end portion of the developing sleeve 132, the cutting processing on the outer surface of the developing sleeve 132 is finished, and the motor 2, the actuator, and the tool rotation motor 20 are stopped. The slide holder 8 is separated from the fixation holder 7, and the developing sleeve 132, of which a great number of the recesses 139 are formed on the outer surface, is taken away from the position between the chuck pins 11 and 15 of the slide holder 8 and the fixation holder 7. Then, an operator sets another developing sleeve 132 so as to be held by the holder unit 4. Thus, cutting processing is performed on the outer surface of the developing sleeve 132, thereby providing the above-described developing sleeve 132, illustrated in FIG. 4, having the outer surface on which a great number of the recesses 139 are formed.

According to the present exemplary embodiment, no convex portions as formed using a conventional sandblasting are formed on the outer surface of the developing sleeve 132, while recesses 139 of a relatively large size are formed on the outer surface of the developing sleeve 132. Such configuration can prevent the recesses 139 from being easily worn out over time, thereby suppressing a reduction in the transport amount of the developer 126 due to a change over time.

The recesses 139 are regularly arranged so as not to overlap with each other on the outer surface of the developing sleeve 132, so that the developer 126 may remain in the recesses 139. Thus, such recesses in which the developer 126 remains are regularly arranged on the outer surface of the developing sleeve 132, thereby preventing uneven image density. Further, such regular arrangement can increase the scoop-up amount of the developer 126 to maintain a high image quality even in a future high-speed image forming apparatus.

Such regular arrangement of the recesses 139 can facilitate setting a processing condition capable of providing a high durability of the developer 126 while securely obtaining a proper scoop-up amount of the developer 126. Such regular arrangement allows the recesses 139 to be securely formed in accordance with such processing condition, thereby providing a preferable easiness of processing.

Further, the plurality of recesses 139 having a long shape in the longitudinal direction of the developing sleeve 132 are regularly arranged on the outer surface of the developing sleeve 132. The total capacity of the recesses 139 is set to not less than 0.5 $mm^3$ per 10 $mm^2$ in the outer surface of the developing sleeve 132. Such configuration can obtain a sufficient transport performance of the developer 126.

Alternatively, the recesses 139 having an identical shape and dimension are regularly arranged, thereby preventing uneven image density due to unevenness in transport performance. Further, the number of the recesses 139 of the developing sleeve 132 is set to not less than 1.0 per 1 mm in the longitudinal direction of the outer surface of the photoconductive drum 108. Accordingly, a plurality of recesses 139 can be provided in the developing area 131, thereby preventing uneven image density due to the slip of the developer 126.

The longitudinal direction of the recesses 139 is disposed parallel to the longitudinal direction of the developing sleeve 132. As a result, scooped portions of the developer 126 are arrayed along the longitudinal direction of the developing sleeve 132. Such configuration can prevent the scooped portions of the developer 126 from easily dropping from the outer surface of the developing sleeve 132 during the rotation of the developing sleeve 132. Thus, the recesses 139 of an elliptic shape can provide an excellent operation effect, thereby obtaining a sufficient scoop amount of the developer 126.

The cross section of the recesses 139 in the longitudinal direction of the developing sleeve 132 is formed in an arc shape. Such configuration can increase the amount of the developer 126 contained in the recesses 139, thereby allowing a sufficient amount of developer 126 to be transported.

Adjacent recesses of the recesses 139 in the circumferential direction of the developing sleeve 13 are offset from each other in the longitudinal direction of the developing sleeve 132. Such configuration can prevent an area not including such recesses 139 and an area including such recesses 139 at a relatively high density from being formed on the outer surface of the developing sleeve 132. As a result, such configuration can prevent unevenness of the developer 126 adhered to the outer surface of the developing sleeve 132. Thus, the developer 126 is allowed to be uniformly adhered on the outer surface of the developing sleeve 132, thereby preventing occurrence of uneven image density.

The recesses 139 are arranged in a spiral shape on the outer surface of the developing sleeve 132. Such configuration can prevent unevenness from occurring in the developer 126 adhered to the outer surface of the developing sleeve 132. In other words, such configuration allows the developer 126 to be uniformly adhered onto the outer surface of the developing sleeve 132, thus preventing occurrence of uneven image density.

As described above, the recesses 139 are formed on the outer surface of the developing sleeve 132 using the end mill 21. Such used of the end mill 21 allows the recesses 139 to be securely and regularly formed on the outer surface of the developing sleeve 132, thereby preventing occurrence of uneven image density.

When the development sleeve 132 is rotated around its axis, the end mill 21 is shifted to form the recesses 139. As a result, the recesses 139 can be securely and regularly on the outer surface of the developing sleeve 132, thereby preventing occurrence of uneven image density.

The development device 113, the process cartridges 106Y, 106M, 106C, and 106K, and the image forming apparatus 101 have the above-described developing roller 115. Such configuration can prevent occurrence of uneven image density while suppressing a reduction in the transport amount of the developer due to a change over time.

Figure 9A:
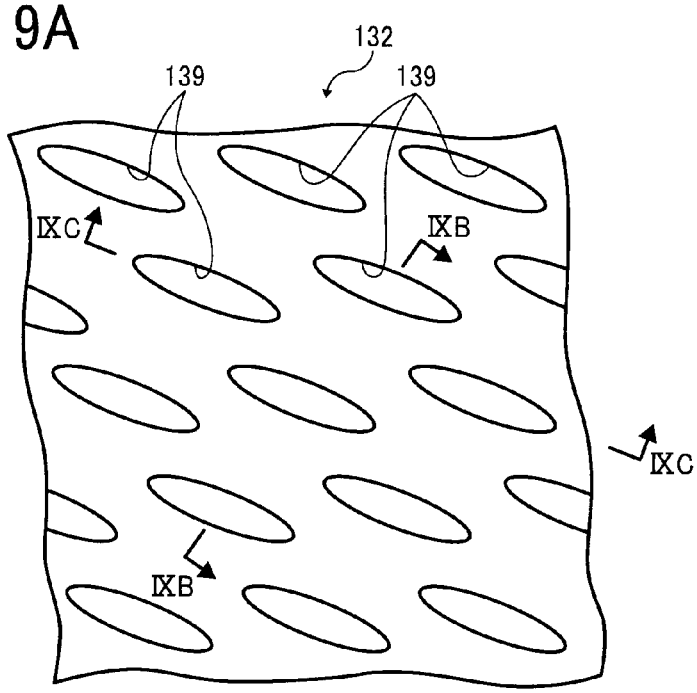
FIG. 9A is an enlarged schematic view illustrating a portion of the outer surface of a variation example of the developing sleeve illustrated in FIG. 6A.
Figure 9B:
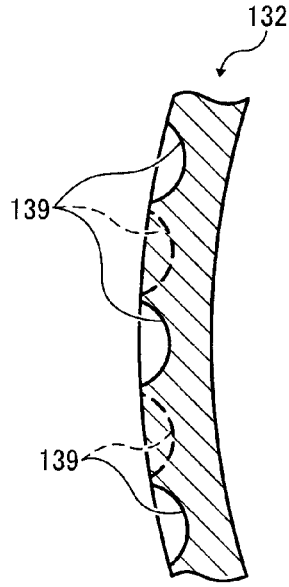
FIG. 9B is a sectional view cut along a line IXB-IXB illustrated in FIG. 9A.
Figure 9C:
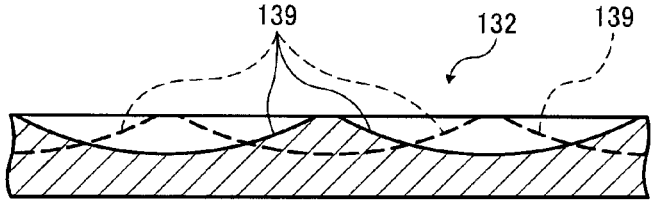
FIG. 9C is a sectional view cut along a line IXC-IXC illustrated in FIG. 9A.

Although in the above-described exemplary embodiment the cross section of the recesses 139 in the circumferential direction of the developing sleeve 132 is formed in a substantially V-shape, it should be noted that the cross section of the recesses 139 in the circumferential direction of the developing sleeve 132 may be formed in an arc shape as illustrated in FIGS. 9A, 9B, and 9C. In FIGS. 9A, 9B, and 9C, the cross section of the recesses 139 in each of the circumferential and longitudinal directions is formed in an arc shape. In such case, as illustrated in FIG. 11, by forming the outer edge 25 of each cutting blade 24 of the end mill 21 in an arc shape, the cross section of the recesses 139 in the circumferential direction of the developing sleeve 132 is formed in the arch shape. Alternatively, in other cases as well as the above-describe case, preferably an angle θ illustrated in FIG. 10 between the inner surface of the recess 139 in the cross section in the circumferential direction of the developing sleeve 132 and the outer surface of the developing sleeve 132 is set to not more than 60 degrees to prevent a difference in development density from being generated by the above-described development magnetic pole. Hereinafter, in FIGS. 9 to 11, components identical to the components of the above-described exemplary embodiment are accompanied with reference numerals identical to the reference numerals of the above-described exemplary embodiment.

Figure 10:
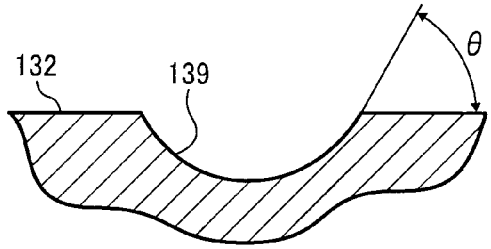
FIG. 10 is an enlarged sectional view illustrating a portion of FIG. 9B.
Figure 11:
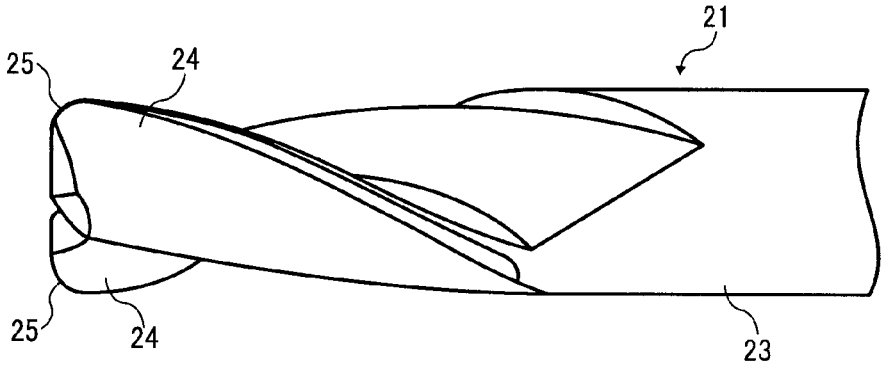
FIG. 11 is an enlarged side view illustrating an end mill for forming recesses on the outer surface of the developing sleeve illustrated in FIGS. 9A to 9C.

In the case illustrated in FIGS. 9 to 11, the cross sections of each recess 139 in both the longitudinal and circumferential directions of the developing sleeve 132 are formed in an arc shape. Such configuration can increase the amount of the developer 126 contained in the recesses 139, thereby transporting a sufficient amount of the developer 126.

Figure 12:
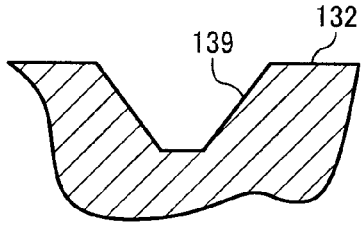
FIG. 12 is a sectional view illustrating a variation example of the recess formed on the outer surface of the developing sleeve illustrated in FIG. 6B.
Figure 13:
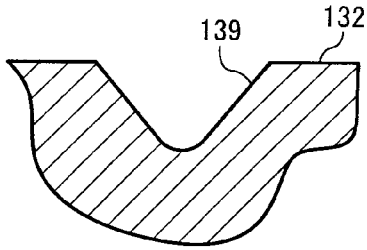
FIG. 13 is a sectional view illustrating another variation example of the recess formed on the outer surface of the developing sleeve illustrated in FIG. 6B.

Although in the above-described exemplary embodiment the cross section of each recess 139 in the circumferential direction of the developing sleeve 132 is formed in a substantially V-shape, it should be noted that in another embodiment such cross section may be formed in any other suitable shape as needed by changing the shape of outer edges 25 of cutting blades 24 into a shape illustrated in FIG. 12 or 13, for example. FIG. 12 illustrates an example in which the substantially V-shaped recess 139 has a flat bottom. FIG. 13 illustrates an example in which the substantially V-shaped recess 139 has an arc-shaped bottom. In FIGS. 12 and 13, components similar to those of the above-described exemplary embodiment are represented by the same reference numerals as the reference numerals of the above-described exemplary embodiment, and redundant descriptions thereof are omitted here.

Figure 14:
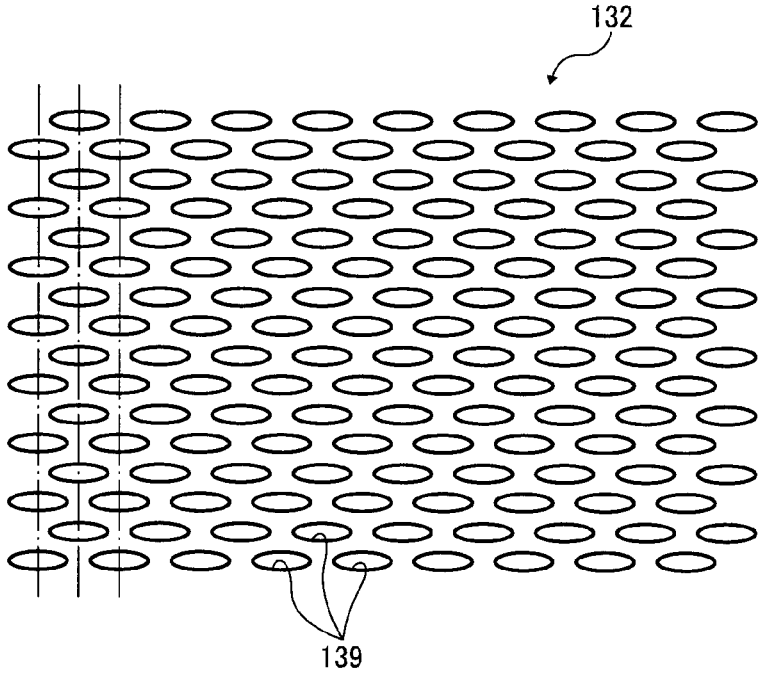
FIG. 14 is a schematic extended view illustrating the outer surface of a variation example of the developing sleeve illustrated in FIG. 5.
Figure 15:
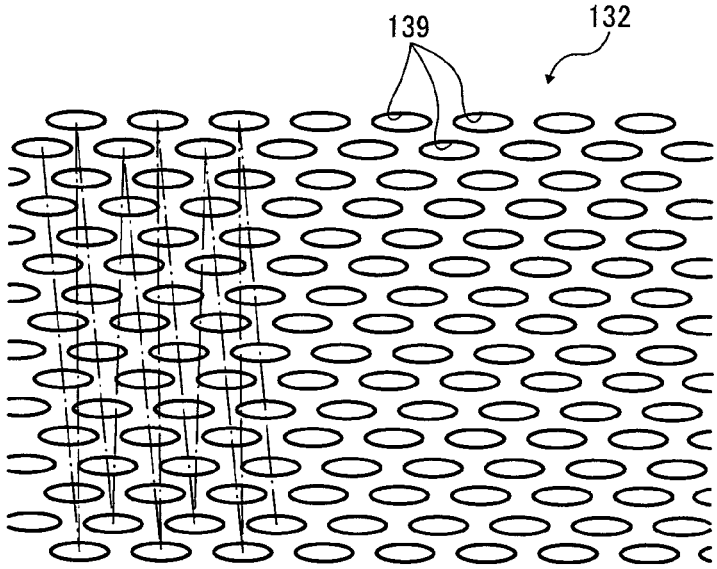
FIG. 15 is a schematic extended view illustrating the outer surface of another variation example of the developing sleeve illustrated in FIG. 5.

In the above-described exemplary embodiment, by continuously driving the motor 2, the tool rotation motor 20, and the actuator simultaneously, the recesses 139 are arranged in a spiral shape on the outer surface of the developing sleeve 132 while each of the recesses 139 is formed in a slightly arc shape. In another embodiment, as illustrated in FIG. 14 or 15, by intermittently driving the motor 2, the tool rotation motor 20, and the actuator as needed, each recess 139 may be formed in a linear shape along each of the longitudinal and circumferential directions of the developing sleeve 132.

Figure 16A:
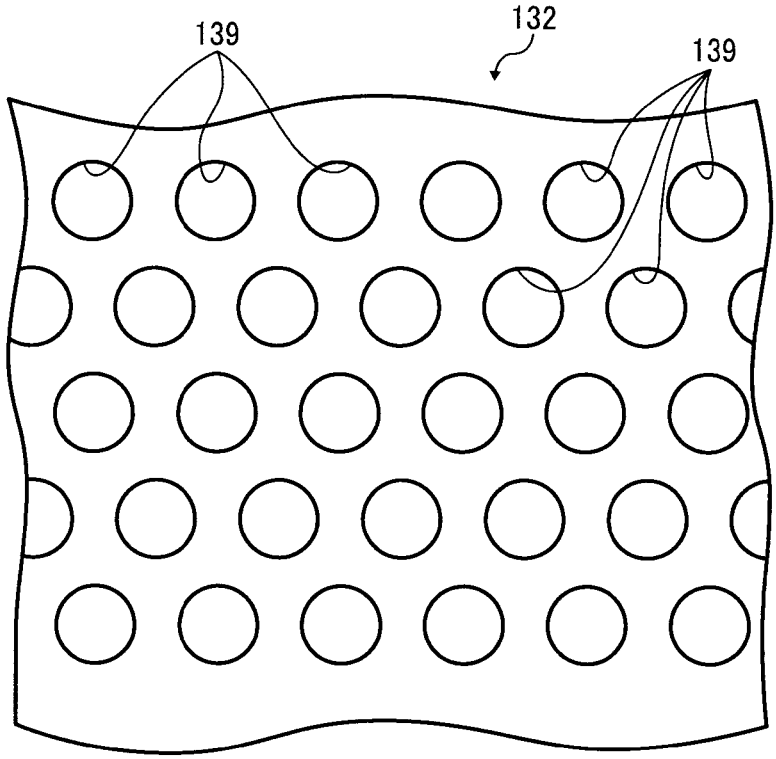
FIG. 16A is a schematic extended view illustrating the outer surface of still another variation example of the developing sleeve illustrated in FIG. 5.
Figure 16B:
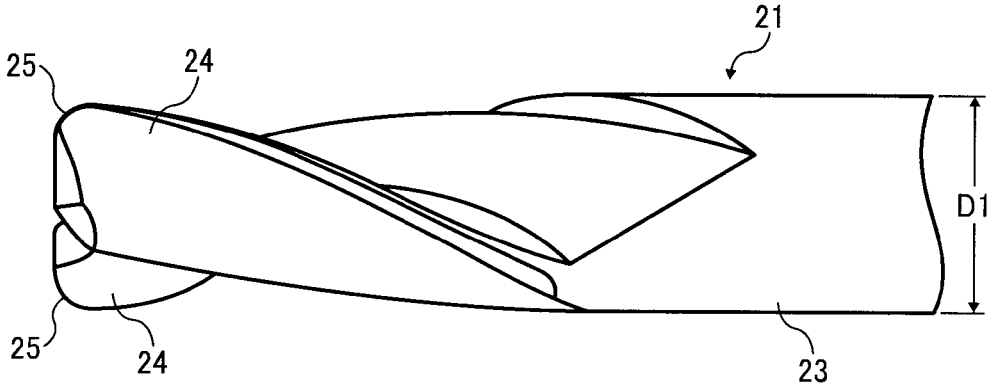
FIG. 16B is an enlarged side view illustrating an end mill for forming recesses illustrated in FIG. 16A.

Although in the above-described exemplary embodiments the recesses 139 are formed in an elliptic shape, it should be noted that in another embodiment such recesses 139 may be formed so as to have a circular shape in plan view as illustrated in FIG. 16A using an end mill 21, as illustrated in FIG. 16B, having an outer diameter D1 smaller than the outer diameter in any of the above-described exemplary embodiments.

In the above-described exemplary embodiment, adjacent recesses of the recesses 139 in the circumferential direction of the developing sleeve 132 are offset from each other by a half of the length of each recess 139. In another embodiment, such adjacent recesses of the recesses 139 in the circumferential direction of the developing sleeve 132 may be offset from each other by any other suitable length, for example, one third or one fourth of the length of each recess 139.

In the above-described exemplary embodiment, the end mill 21 is moved along the longitudinal direction of the developing sleeve 132 so that the end mill 21 and the developing sleeve 132 are relatively moved. It should be noted that at least one of the end mill 21 and the developing sleeve 132 may be moved along the longitudinal direction of the developing sleeve 132 so that the end mill 21 and the developing sleeve 132 are relatively moved.

Figure 21A:
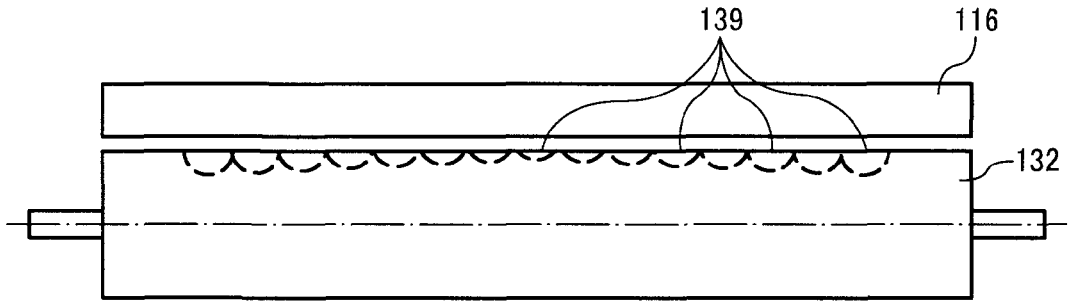
FIG. 21A is an extended schematic view illustrating a cross section of the outer surface of a variation example of the developing sleeve illustrated in FIG. 5 in which the depth of recesses gradually increases from a middle portion to each end portion in the longitudinal direction of the developing sleeve.
Figure 21B:
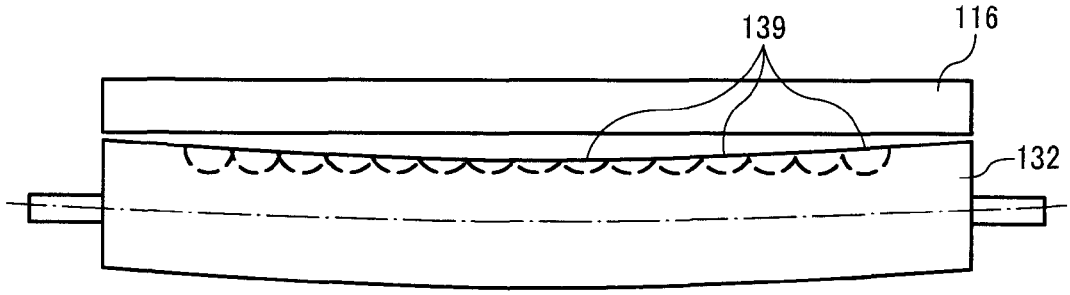
FIG. 21B is a schematic view illustrating a state in which the developing sleeve is bent.

In the above-described exemplary embodiment, the recesses 139 are regularly arranged on the outer surface of the developing sleeve 132. It should be noted that, as illustrated in FIG. 21A, such recesses 139 may be formed so as to become gradually deeper from a middle portion to each end portion in the longitudinal direction of the developing sleeve 132. With such configuration, the volume of the recesses 139 is gradually increased from the middle portion to each end portion in the longitudinal direction of the developing sleeve 132. In this regard, a friction resistance or a magnetic attraction generated when developer passes through the doctor gap may bend the developing roller 115 as illustrated in FIG. 21B, so that the doctor gap may become relatively wider at a middle portion than each end portion in the longitudinal direction of the developing sleeve 132. Even in such case, the above-described configuration allows the developer to be transported approximately uniformly in the longitudinal direction of the developing roller 115, thereby preventing occurrence of uneven image density.

Alternatively, as illustrated in FIG. 22, such recesses 139 may be irregularly arranged so that the area of each recess 139 in plan view gradually increases and the interval between the recesses 139 gradually becomes smaller from a middle portion to each end portion in the longitudinal direction of the developing sleeve 132. With such configuration, the volume of the recesses 139 gradually increases from the middle portion to each end portion in the longitudinal direction of the developing sleeve 132. Accordingly, such configuration allows the developer to be transported approximately uniformly in the longitudinal direction of the developing roller 115, thereby preventing occurrence of uneven image density.

In another embodiment, as illustrated in FIG. 23, the recesses 139 may be irregularly arranged so that the number of the recesses 139 per unit area gradually increases or the interval of the recesses 139 gradually becomes smaller from the middle portion to each end portion in the longitudinal direction of the developing sleeve 132. With such configuration, the volume of the recesses 139 gradually increases from the middle portion to each end portion in the longitudinal direction of the developing sleeve 132. Accordingly, such configuration allows the developer to be transported approximately uniformly in the longitudinal direction of the developing roller 115, thereby preventing occurrence of irregularity in image density. In FIGS. 21 to 23, components similar to the components of the above-described exemplary embodiment are represented by reference numerals identical to the reference numerals of the above-described exemplary embodiment, and redundant descriptions thereof are omitted here. Further, unless regarded as a departure from the spirit and scope of the present invention, any suitable set of values may be used for the depth, the area in plan view, and the number per unit area of the recesses 139.

In the above-described image forming apparatus 101, each of the process cartridges 106Y, 106M, 106C, and 106K has the cartridge case 111, the charging roller 109, the photoconductive drum 108, the cleaning blade 112, and the developing device 113, for example. It should be noted that each of the process cartridges 106Y, 106M, 106C, 106K may have the developing device 113 without the cartridge case 111, the charging roller 109, the photoconductive drum 108, and the cleaning blade 112. According to the above-described exemplary embodiment, the image forming apparatus 101 has the process cartridges 106Y, 106M, 106C, and 106K detachably mountable to the apparatus body 102. It should be noted that the image forming apparatus 101 may have the developing device 113 without the process cartridges 106Y, 106M, 106C, and 106K.

Figure 17:
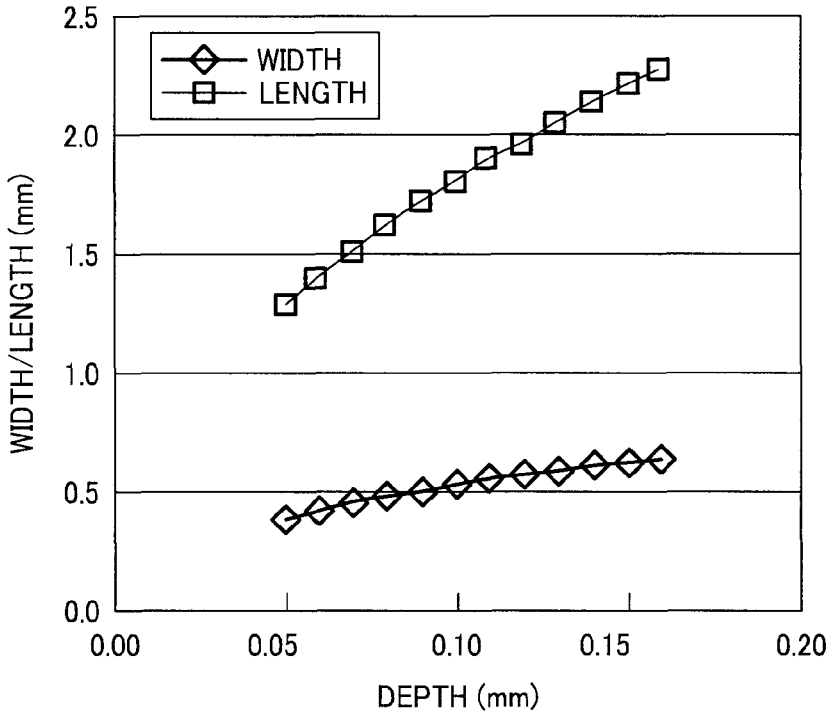
FIG. 17 illustrates a relation between the depth and each of the length and width of recesses.
Figure 19:
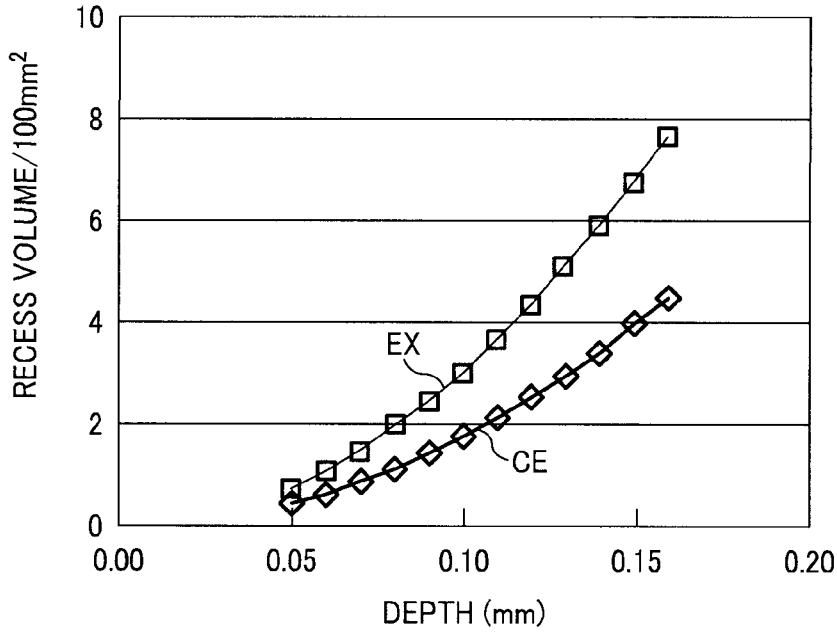
FIG. 19 illustrates a relation between the depth of recesses and the total volume of recesses per 100 $mm^2$ in each of an example according to an exemplary embodiment and a comparative example.

The inventors of the present invention prototyped a developing sleeve 132 using a surface processing device 1 according to the above-described exemplary embodiment and measured recesses 139 formed on the developing sleeve 132. The results of measurement are illustrated in FIGS. 17 and 19. In this example, using the end mill 21 having an outer diameter of 6 mm, recesses 139 were formed on the developing sleeve 132 of aluminum having an outer diameter of 18 mm. The rotation speed of the developing sleeve 132 was set to 60 rpm (revolutions per minute), the rotation speed of the end mill 21 was set to 1245 rpm, and the moving speed of the end mill 21 in the longitudinal direction of the developing sleeve 132 was set to 1 mm per revolution.

The cross section of each recess 139 in the circumferential direction of the developing sleeve 132 is formed in an arc shape having a curvature radius of 0.4 mm. The cross section of each recess 139 in the longitudinal direction of the developing sleeve 132 is formed in an arch shape having a curvature radius of 3.0 mm. The recesses 139 are arranged so that the interval between the recesses 139 in the longitudinal direction of the developing sleeve 132 is 2.0 mm.

Figure 18:
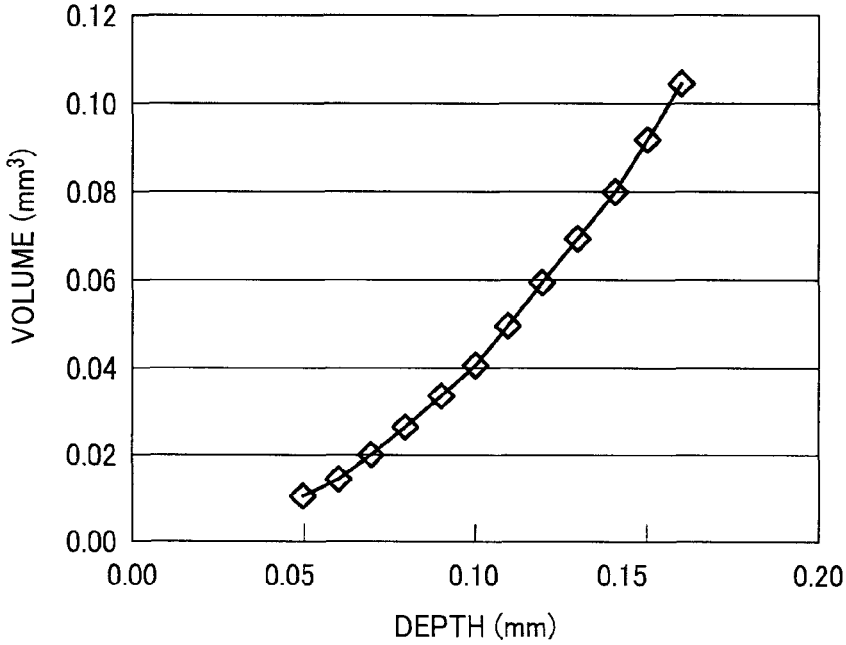
FIG. 18 illustrates a relation between the depth and the volume of recesses.

FIG. 17 illustrates a relation between the depth of the recesses 139 and each of the width and length thereof. FIG. 18 illustrates the volume per recess 139. FIG. 19 illustrates the volume of recesses 139 per 100 $mm^2$ of the outer surface of the developing sleeve 132 in this example EX. FIG. 19 also illustrates, as a comparative example CE, a conventional type of developing sleeve having an outer surface on which one-hundred grooves are formed. FIGS. 17 to 19 indicate that use of the above-described surface processing device 1 allows such recesses 139 to be securely formed at a predetermined size.

Figure 20:
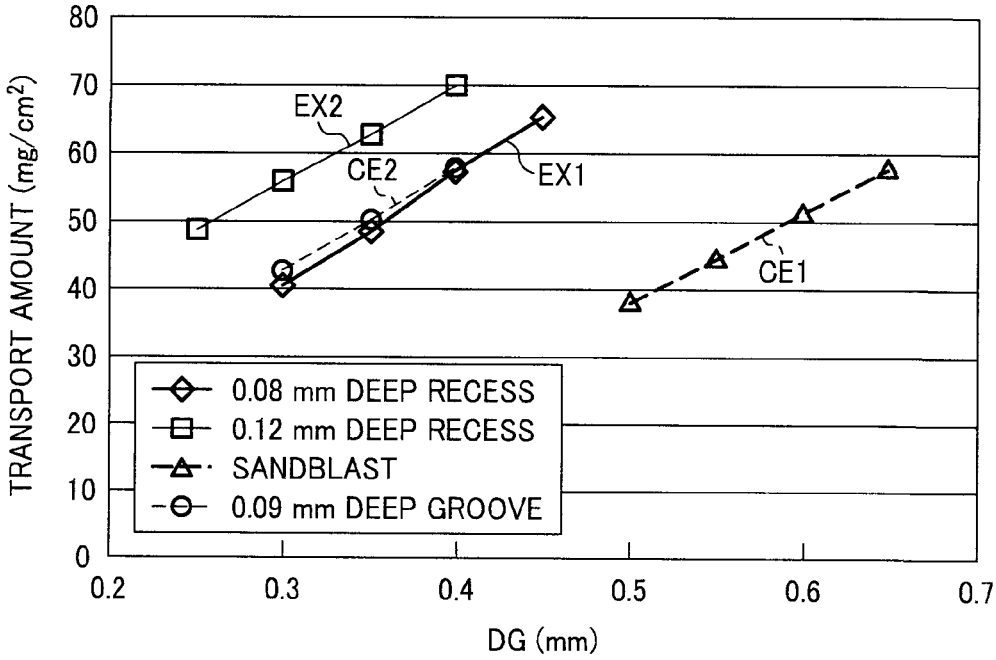
FIG. 20 illustrates a relation between the transport amount of developer and the gap between the developing roller and the doctor blade in a first example, a second example, a first comparative example, and a second comparative example.

In FIG. 20, the scoop amount of toner was measured on a first example EX1 having 0.08 mm-deep recesses 139, a second example EX2 having 0.12 mm-deep recesses 139, a first comparative example CE1 obtained by sandblasting, and a second comparative example CE2 having one-hundred grooves of 0.09 mm depth. In FIG. 20, the horizontal axis represents the gap between the doctor blade 116 and the developing roller 115 while the vertical axis represents the transport amount of developer. FIG. 20 indicates that each of the examples EX1 and EX2 had a transport performance similar to or higher than any of the comparative examples CE1 and CE2. FIG. 20 also indicates that, when image evaluation is conducted for such developing sleeves 132, pitch-like uneven density was prevented from occurring.

Examples and embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. A developing roller comprising:

a developing sleeve; and a magnet roller disposed within the developing sleeve to attract developer to an outer surface of the developing sleeve by magnetic force, the outer surface of the developing sleeve having a plurality of recesses configured with a predetermined circular or elliptic shape in plan view regularly arranged therein so as not to overlap and so as to convey the developer, wherein adjacent ones of the plurality of recesses are arranged on the developing sleeve regularly at a specific interval in each of a circumferential and a longitudinal direction, a longitudinal direction of each of the recesses in the outer surface of the developing sleeve is parallel to a longitudinal direction of the developing sleeve, and each of the recesses in the outer surface of the developing sleeve has a substantially V-shaped cross section in a circumferential direction of the developing sleeve and has an arc-shaped cross section in the longitudinal direction of the developing sleeve.

2. The developing roller according to claim 1, wherein, of the plurality of recesses, adjacent recesses in a circumferential direction of the developing sleeve are offset from each other in a longitudinal direction of the developing sleeve.

3. The developing roller according to claim 1, wherein a volume of each of the recesses gradually increases from a middle portion toward each end portion in a longitudinal direction of the developing sleeve.

4. The developing roller according to claim 3, wherein a depth of each of the recesses gradually increases from the middle portion toward each end portion in the longitudinal direction of the developing sleeve.

5. The developing roller according to claim 3, wherein an area of each of the recesses gradually increases from the middle portion toward each end portion in the longitudinal direction of the developing sleeve.

6. The developing roller according to claim 3, wherein a number of the recesses per unit area gradually increases from the middle portion toward each end portion in the longitudinal direction of the developing sleeve.

7. The developing roller according to claim 1, wherein the recesses are arranged in a spiral manner on the outer surface of the developing sleeve.

8. The developing roller according to claim 1, wherein the recesses are cut into the outer surface of the developing sleeve using a rotational tool rotated around an axis of the rotational tool.

9. The developing roller according to claim 8, wherein the recesses are formed by relatively moving the rotational tool and the developing sleeve in a longitudinal direction of the developing sleeve when the developing sleeve disposed so as to cross the axis of the rotational tool is rotated around an axis of the developing sleeve.

10. The developing roller of claim 1, wherein the predetermined circular or elliptic shape of the plurality of recesses corresponds to a closed circular or elliptic shape of predetermined dimensions.

11. The developing roller of claim 1, wherein the recesses are configured to carry the developer that is attracted to the outer surface of the developing sleeve, the developer including toner and magnetic carrier powder.

12. The developing roller of claim 1, wherein adjacent recesses are arranged on the developing sleeve at a first specific interval in the circumferential direction and a second specific interval in the longitudinal direction.

13. A developing roller comprising:

a developing sleeve; and a magnet roller disposed within the developing sleeve to attract developer to an outer surface of the developing sleeve by magnetic force, the outer surface of the developing sleeve having a plurality of recesses configured with a predetermined circular or elliptic shape in plan view regularly arranged therein so as not to overlap and so as to convey the developer, wherein adjacent ones of the plurality of recesses are arranged on the outer surface of the developing sleeve regularly at a specific interval in each of a circumferential and a longitudinal direction, and a longitudinal direction of each of the recesses in the outer surface of the developing sleeve is parallel to a longitudinal direction of the developing sleeve, and each of the recesses in the outer surface of the developing sleeve has an arc-shaped cross section in a circumferential direction of the developing sleeve and has an arc-shaped cross section in the longitudinal direction of the developing sleeve.

14. A developing device comprising a developing roller, the developing roller having a developing sleeve and a magnet roller disposed within the developing sleeve to attract developer to an outer surface of the developing sleeve by magnetic force, the outer surface of the developing sleeve having a plurality of recesses configured with a predetermined circular or elliptic shape in plan view regularly arranged therein so as not to overlap and so as to convey the developer, wherein adjacent ones of the plurality of recesses are arranged on the outer surface of the developing sleeve regularly at a specific interval in each of a circumferential and a longitudinal direction, a longitudinal direction of each of the recesses in the outer surface of the developing sleeve is parallel to a longitudinal direction of the developing sleeve, and each of the recesses in the outer surface of the developing sleeve has a substantially V-shaped cross section in a circumferential direction of the developing sleeve and has an arc-shaped cross section in the longitudinal direction of the developing sleeve.

15. A process cartridge comprising the developing device according to claim 14.

16. An image forming apparatus, comprising:

an image carrier;

a charging device; and the developing device according to claim 14.

* * * * *